US010991290B1

(12) United States Patent
Yang et al.

(10) Patent No.: US 10,991,290 B1
(45) Date of Patent: Apr. 27, 2021

(54) CONTROL METHOD OF CHANNEL SETTING MODULE APPLIED TO DISPLAY PANEL

(71) Applicant: NOVATEK MICROELECTRONICS CORP., HsinChu (TW)

(72) Inventors: Hsiu-Hui Yang, Hsinchu (TW); Yu-Shao Liu, Kaohsiung (TW); Chin-Hung Hsu, Taoyuan (TW); Yen-Cheng Cheng, Hsinchu (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 0 days.

(21) Appl. No.: 17/064,640

(22) Filed: Oct. 7, 2020

(51) Int. Cl.
*G09G 3/20* (2006.01)

(52) U.S. Cl.
CPC ..... *G09G 3/20* (2013.01); *G09G 2310/0291* (2013.01); *G09G 2310/0297* (2013.01)

(58) Field of Classification Search
CPC ..... G09G 3/20; G09G 2310/0297; G09G 2310/0291
See application file for complete search history.

(56) References Cited

U.S. PATENT DOCUMENTS

| | | | | |
|---|---|---|---|---|
| 9,721,491 | B2 * | 8/2017 | Pai | G09G 3/20 |
| 2018/0197485 | A1 * | 7/2018 | Jose | G09G 3/3614 |
| 2018/0217466 | A1 * | 8/2018 | Nomura | G02F 1/13452 |
| 2019/0043440 | A1 * | 2/2019 | Ishida | G09G 3/3688 |
| 2019/0088229 | A1 * | 3/2019 | Morita | G09G 3/3696 |
| 2020/0302888 | A1 * | 9/2020 | Van Ostrand | G09G 3/3688 |

* cited by examiner

*Primary Examiner* — Andrew Sasinowski
(74) *Attorney, Agent, or Firm* — McClure, Qualey & Rodack, LLP

(57) ABSTRACT

Control methods of a channel setting module applied to a display panel are provided. The display panel has gate lines, source lines, and pixels. The pixels are arranged in matrix. The pixels disposed at the same row are electrically connected to the same gate line, and the pixels disposed at the same column are electrically connected to the same source line. The adoption of the channel setting module reduces the control signals required by the source lines. The channel setting module includes operational amplifiers and de-mux switches, and the control methods dynamically determine conduction states of the de-mux switches. The voltage outputs of the operational amplifiers are selectively outputted to the source lines, depending on conduction statuses of the de-mux switches. By applying the control methods, the interference between the source lines are reduced, and the instantaneous overshoots/undershoots of floating channels are depressed.

20 Claims, 13 Drawing Sheets

CONTROL METHOD OF CHANNEL SETTING MODULE APPLIED TO DISPLAY PANEL

TECHNICAL FIELD

The disclosure relates in general to control methods of a channel setting module applied to a display panel, and more particularly to control methods of a channel setting module applied to a display panel capable of depressing coupling effects between source lines.

BACKGROUND

FIG. 1 is a schematic diagram illustrating the structure of a display device. The display device 10 includes a timing controller 12, a display panel 11, a source driver 13, and a gate driver 15 (or a gate on array (hereinafter, GOA)). The source driver 13 receives source control signals $S_{src_ctl}$ from the timing controller 12, and the gate driver 15 receives the gate control signals $S_{gl_ctl}$ from the timing controller 12. The source driver 13 is a circuit disposed outside the display panel 11, and the gate driver 15 can be directly formed on or disposed outside the display panel 11. In the specification, the source driver 13 is assumed to be disposed at the upper side of the display panel 11, and the gate driver 15 is assumed to be disposed at the left side of the display panel 11.

In the specification, different capital variables are utilized to represent the number of components. These variables (for example, X, Y, M, J) are positive integers, and their lower-case letters are utilized to represent the generalized item. The signal lines and the signals being transmitted by the signal lines are represented as the same symbols. For example, the source lines and the signals being transmitted through the source lines are represented as SL.

The display panel 11 includes pixels 11*a* being arranged in a matrix, X source lines SL[1]~SL[X], and Y gate lines GL[1]~GL[Y]. Colors and types of the pixels 11*a* are not limited. For example, the pixels 11*a* can be red pixels, green pixels, or blue pixels, and the pixels 11*a* can be OLED pixels, LCD pixels, and so forth.

The pixels 11*a* disposed at the same column are electrically connected to the same source line SL, and the pixels 11*a* disposed at the same row are electrically connected to the same gate line GL. For example, the pixels 11*a* disposed at the first column are electrically connected to the source line DL[1], and the pixels 11*a* disposed at the X-th column are electrically connected to the source line SL[X]. Similarly, the pixels 11*a* disposed at the first row are electrically connected to the gate line GL[1], and the pixels disposed at the Y-th row are electrically connected to the gate line GL[Y]. For the sake of illustration, the pixels 11*a* disposed at the y-th row are described.

The timing controller 12 alternately controls the pixels 11*a* in a row-by-row manner. In the horizontal line duration T_pln(y) (wherein y=1~Y), the timing controller 12 transmits source control signals $S_{src_ctl}$, corresponding to the X pixels 11*a* disposed at the y-th row, to the source driver 13.

The de-multiplexing technique is adopted to reduce the manufacturing cost of the source driver 13. As shown in FIG. 1, the source driver 13 includes M source control modules (srcMDL_1~srcMDLM) and M channel setting modules (setMDL_1~setMDL_M). The source control modules srcMDL_1~srcMDL_M are respectively corresponding to the channel setting modules setMDL_1~setMDL_M. For illustration purposes, it is assumed that each of the channel setting modules setMDL is corresponding to J source lines (for example, J=4 in the specification).

Once the de-multiplexing technique is utilized, the timing controller 12 does not need to control all the source lines SL[1]~SL[X] simultaneously. Instead, the timing controller 12 sends the source control signals $S_{src_ctl}$ in a time-division approach. That is, for the J source lines being electrically connected to the m-th channel setting module setMDL_m, only the j-th source line ($SL_{mj}$) receives the output voltage from the m-th channel setting module setMD_m in the j-th de-multiplexed duration. The mapping between the source line SL[1]~SL[X] and the channel setting modules setMDL_1~setMDL_M can be summarized in Table 1.

TABLE 1

| channel setting module | source lines |
|---|---|
| setMDL_1 | 1~J |
| setMDL_m | J * (m − 1) + 1~J * M |
| setMDL_M | (X − J + 1)~X, wherein X = J * M |

FIG. 2 is a schematic diagram illustrating the overshoot phenomenon of the floating source line SL[x]. The duration between time point t1 and time point t5 is the horizontal line duration T_pln(y) corresponding to the pixels 11*a* disposed at the y-th row.

Between time point t2 and time point t3, the source line SL[x](wherein x=1~X) is biased by the output voltage so that the potential of the source line SL[x] rises to the predefined pixel voltage $V_{pxl}$. The predefined pixel voltage $V_{pxl}$ corresponds to the luminous intensity of the pixel 11*a* disposed at the x-th column and the y-th row.

Between time point t3 and time point t4, the source line SL[x] becomes floating. In this duration, the potential of the source line SL[x] might be affected by the potential of its adjacent source line (for example, the source line SL[x+1]), which is biased in the meanwhile.

The use of the de-multiplexing technique implies that the source lines connected to the same channel setting module are biased alternately. Due to the coupling effects between the source lines, the potential of the source line, which has been biased previously, might be affected by the source line being biased later.

For example, an overshoot of the source line SL[x] occurs soon after time point t3. The overshoot results in that the potential of the x-th source line SL[x] becomes slightly higher than the predefined pixel voltage $V_{pxl}$, with a pixel voltage error ΔV. Consequently, the luminous intensity of the pixel 11*a* disposed at the x-th column and the y-th row deviates. Therefore, the coupling effects between the driven (biased) source lines and the floating source lines become an issue.

Please note that the coupling effects between source lines might result in undershoot as well. The types and amplitudes of the phenomenon caused by coupling are determined by the polarity and values of the neighboring source line being driven.

SUMMARY

The disclosure is directed to control methods of a channel setting module applied to a display panel. The channel setting module dynamically provides output voltages to source lines of the display panel as channel inputs. The voltages of the source lines may suffer unexpected change when de-multiplexer switching circuits are adopted for saving cost, and the control methods proposed in the present disclosure are capable of depressing such unexpected variation of the floating channels.

According to one embodiment, a control method of a channel setting module applied to a display panel is provided. The channel setting module includes a first operational amplifier and a second operational amplifier. The control method includes the following steps. In a first de-multiplexed duration, an output voltage of the first operational amplifier is supplied to a first source line of the display panel, and an output voltage of the second operational amplifier is supplied to a second source line of the display panel. In a second de-multiplexed duration, the output voltage of the first operational amplifier is supplied to a third source line of the display panel, and the output voltage of the second operational amplifier is supplied to the second source line of the display panel. Ina third de-multiplexed duration, the output voltage of the first operational amplifier is supplied to the third source line of the display panel, and the output voltage of the second operational amplifier is supplied to a fourth source line of the display panel. The first de-multiplexed duration is before the second de-multiplexed duration, and the second de-multiplexed duration is before the third de-multiplexed duration.

According to another embodiment, a control method of a channel setting module applied to a display panel is provided. The channel setting module includes a first and a second operational amplifiers. The control method includes the following steps. In a first de-multiplexed duration, an output voltage of the first operational amplifier is supplied to a first source line of the display panel, and an output voltage of the second operational amplifier is supplied to a second source line of the display panel. In a second de-multiplexed duration, the output voltage of the first operational amplifier is supplied to a third source line of the display panel, and the output voltage of the second operational amplifier is supplied to a fourth source line of the display panel. Ina third de-multiplexed duration, the output voltage of the first operational amplifier is supplied to the first source line, and the output voltage of the second operational amplifier is supplied to the second source line. The first de-multiplexed duration is before the second de-multiplexed duration, and the second de-multiplexed duration is before the third de-multiplexed duration.

According to an alternative embodiment, a control method of a channel setting module applied to a display panel is provided. The display panel includes a first, a second, a third, and a fourth source lines, and the channel setting module includes a first and a second operational amplifiers. The control method includes the following steps. Firstly, a first, a second, a third, and a fourth converted signals are received from a first, a second, a third, and a fourth converting circuits, respectively. Then, the first converted signal is amplified, by the first operational amplifier, to generate an output voltage of the first operational amplifier, and the second converted signal is amplified, by the second operational amplifier, to generate an output voltage of the second operational amplifier. In a first de-multiplexed duration, the output voltage of the first operational amplifier is supplied to one of the third source line and the fourth source line, and the output voltage of the second operational amplifier is supplied to the other of the third source line and the fourth source line. In a second de-multiplexed duration, the output voltage of the first operational amplifier is supplied to one of the first source line and the second source line, the output voltage of the second operational amplifier is supplied to the other of the first source line and the second source line, the third converted signal is conducted to the one of the third source line and the fourth source line, and the fourth converted signal is conducted to the other of the third source line and the fourth source line. The first de-multiplexed duration is before the second de-multiplexed duration.

Figure 1:
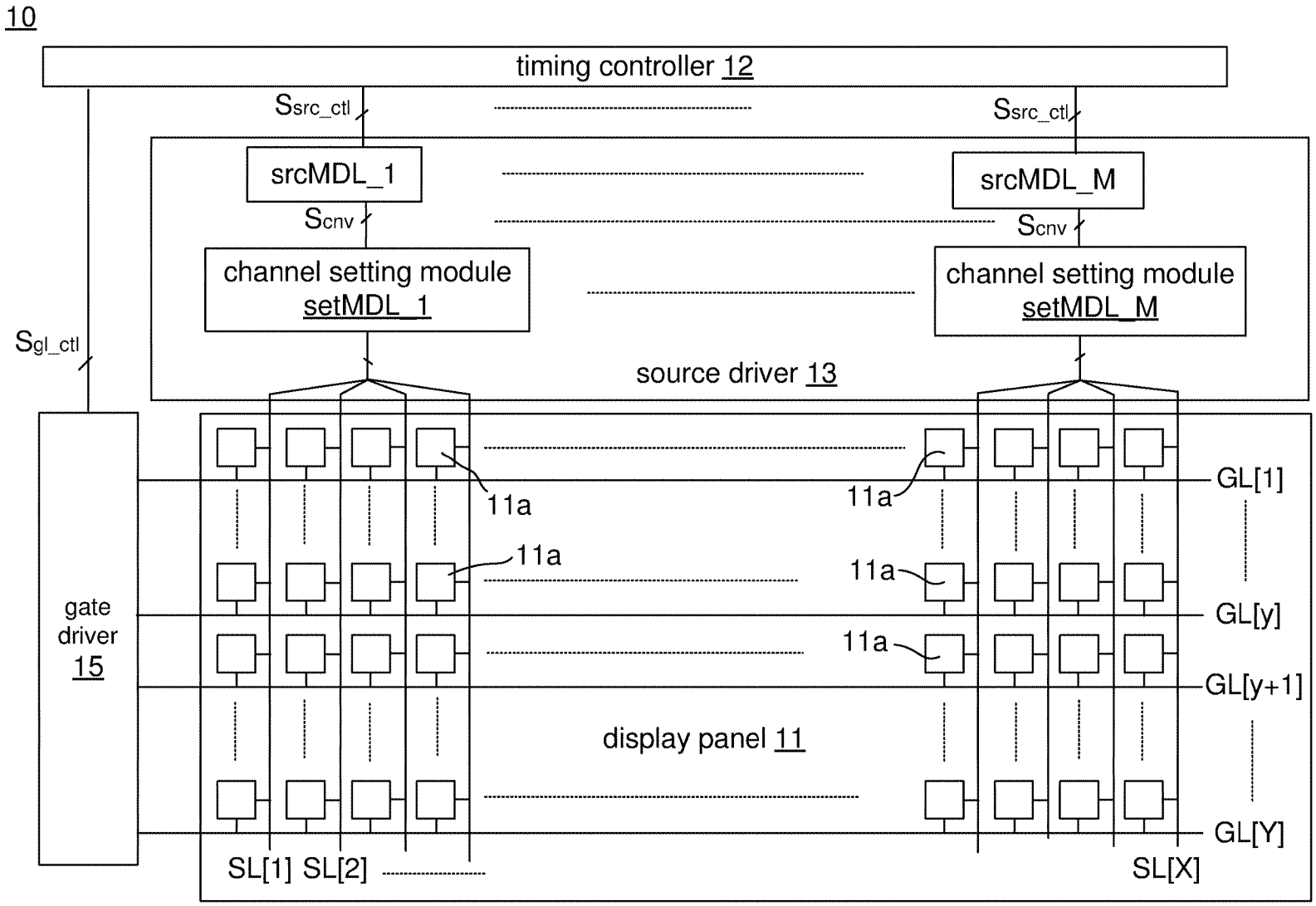
FIG. 1 (PRIOR ART)
FIG. 1 (prior art) is a schematic diagram illustrating the structure of a display device.
Figure 2:
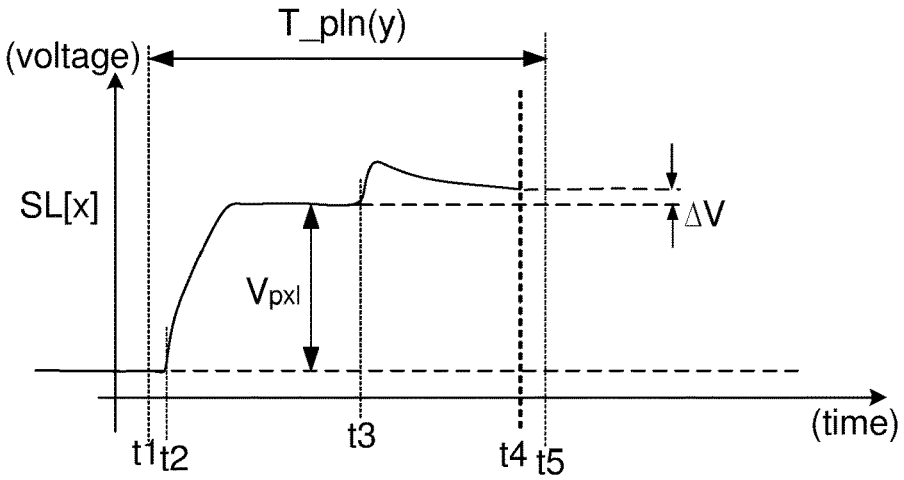
FIG. 2 (PRIOR ART)
FIG. 2 (prior art) is a schematic diagram illustrating the phenomenon of instantaneous overshoot of the source line SL[x].

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

To suppress the unexpected potential changes of the floating source lines SL, different embodiments are illustrated below. In the following embodiments, the channel setting modules setMDL_m are assumed to correspond to J=4 source lines ($SL_{m1}$, $SL_{m2}$, $SL_{m3}$, $SL_{m4}$). Nevertheless, with appropriate modifications, the control methods described below can also be applied to the channel setting modules setMDL_m corresponding to the different number of source lines SL.

Figure 3:
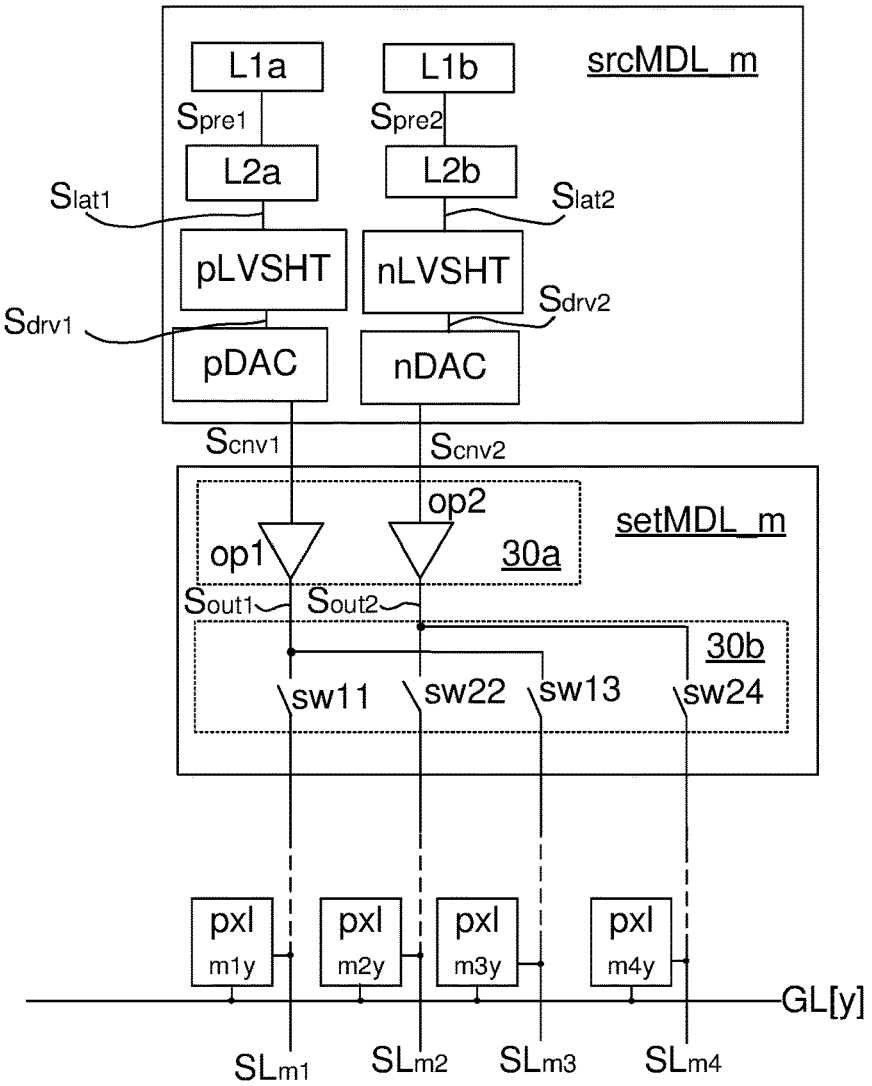
FIG. 3 is a schematic diagram illustrating the channel setting module setMDL_m corresponding to the first and the second embodiments of the present disclosure.

FIG. 3 is a schematic diagram illustrating the design of the source control module srcMDL_m and the channel setting module setMDL_m to which the first and the second embodiments of the present disclosure are applied. The internal components of the source control modules srcMDL_m and the channel setting module setMDL_m are respectively illustrated.

The source control modules srcMDL_m includes first stage latches L1*a*, L1*b*, second stage latches L2*a*, L2*b*, level shifters pLVSHT, nLVSHT, and converting circuits pDAC, nDAC. The converting circuits pDAC, nDAC are digital-to-analog converters used for converting digital video data (hereinafter, driving signals $S_{drv1}$, $S_{drv2}$) into analog data voltages (hereinafter, converted signals $S_{cnv1}$, $S_{cnv2}$).

The second stage latch L2*a* is electrically connected to the first stage latch L1*a* and the level shifter pLVSHT. The second stage latch L2*b* is electrically connected to the first stage latch L1*b* and the level shifter nLVSHT. The converting circuit pDAC is electrically connected to the level shifter pLVSHT and the channel setting module setMDL_m, and the converting circuit nDAC is electrically connected to the level shifter nLVSHT and the channel setting module setMDL_m.

In the first and the second embodiments, the source control signals $S_{src_ctl}$ include video signals for the first stage latches L1*a*, L1*b*, the loading signal LD for the second stage latches L2*a*, L2*b*, and the switch-setting signals for controlling de-mux switches in the buffer 30*a*. The first stage latches L1*a*, L1*b* receive video signals from the timing controller. Then, the first stage latches L1*a*, L1*b* respectively generate pre-data $S_{pre1}$, $S_{pre2}$ to the second stage latches L2*a*, L2*b*. Later, the second stage latches L2*a*, L2*b* generate and transmit the latched data $S_{lat1}$, $S_{lat2}$ to the level shifters pLVSHT, nLVSHT, in response to the loading pulse of the loading signal LD. The level shifters pLVSHT, nLVSHT respectively generate the driving signals $S_{drv1}$, $S_{drv2}$ based on the latched data $S_{lat1}$, $S_{lat2}$. The converting circuits pDAC, nDAC respectively receive the driving signals $S_{drv1}$, $S_{drv2}$ from the level shifters pLVSHT, nLVSHT, convert the driving signals $S_{drv1}$, $S_{drv2}$ to the converted signals $S_{cnv1}$, $S_{cnv2}$, and transmit the converted signals $S_{cnv1}$, $S_{cnv2}$ to the channel setting module setMDL_m.

The channel setting module setMDL_m further includes a buffer 30*a* and a de-multiplexer switching circuit 30*b*. The buffer 30*a* includes the operational amplifiers op1, op2, and the de-mutiplexer switching circuit 30*b* includes de-mux switches sw11, sw22, sw13, sw24. The operational amplifier op1 amplifies the converted signal $S_{cnv1}$ to generate the output voltage $S_{out1}$, and the operational amplifier op2 amplifies the converted signal $S_{cnv2}$ to generate the output voltage $S_{out2}$. The de-mux switches sw11, sw22, sw13, sw24 are selectively turned on/off.

The operational amplifier op1 is electrically connected to the converting circuit pDAC, and the de-mux switches sw11, sw13. The operational amplifier op2 is electrically connected to the converting circuit nDAC, and the de-mux switches sw22, sw24. The de-mux switches sw11, sw22, sw13, sw24 are respectively electrically connected to the source lines $SL_{m1}$, $SL_{m2}$, $SL_{m3}$, $SL_{m4}$.

The pixels, which are corresponding to the channel setting module setMDL_m and disposed at the y-th row, are shown. The pixels $pxl_{m1y}$, $pxl_{n2y}$, $pxl_{m3y}$, $pxl_{m4y}$ are jointly electrically connected to the gate line GL[y], and the pixels $pxl_{m1y}$, $pxl_{m2y}$, $pxl_{m3y}$, $pxl_{m4y}$ are respectively electrically connected to the source lines $SL_{m1}$, $SL_{m2}$, $SL_{m3}$, $SL_{m4}$. When the de-mux switch sw11 is turned on, the output voltage $S_{out1}$ of the operational amplifier op1, being equivalent to the pixel voltage $V_{m1y}$, is transmitted to the pixel pxlm1*y* through the de-mux switch sw11. The operations of other de-mux switches sw22, sw13, sw24 are similar.

In FIG. 3, two output channels are defined. In one output channel, the first stage latch L1*a*, the second stage latch L2*a*, the level shifter pLVSHT, and the converting circuit pDAC are corresponding to the operational amplifier op1. In the other output channel, the first stage latch L1*b*, the second stage latch L2*b*, the level shifter nLVSHT, and the converting circuit nDAC are corresponding to the operational amplifier op2.

Figure 4A:
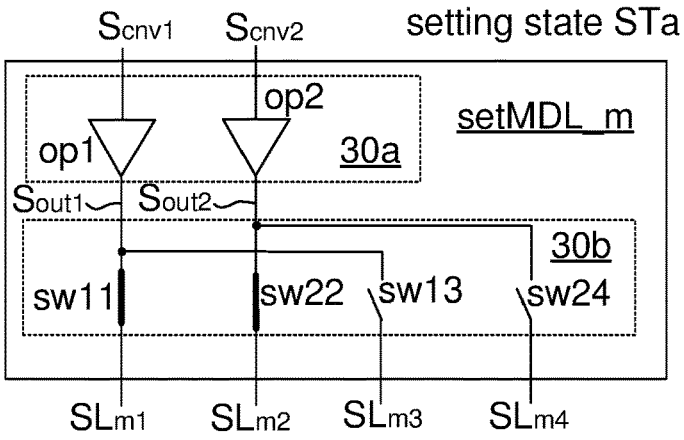
FIGS. 4A-4C are schematic diagrams illustrating different setting states of the channel setting module setMDL_m in FIG. 3.
Figure 4B:
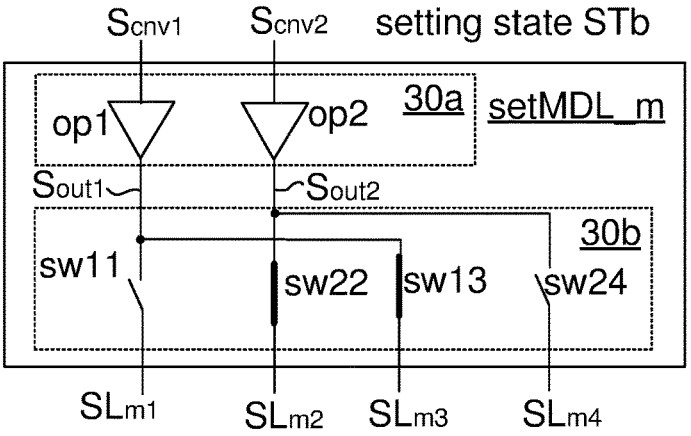
Figure 4C:
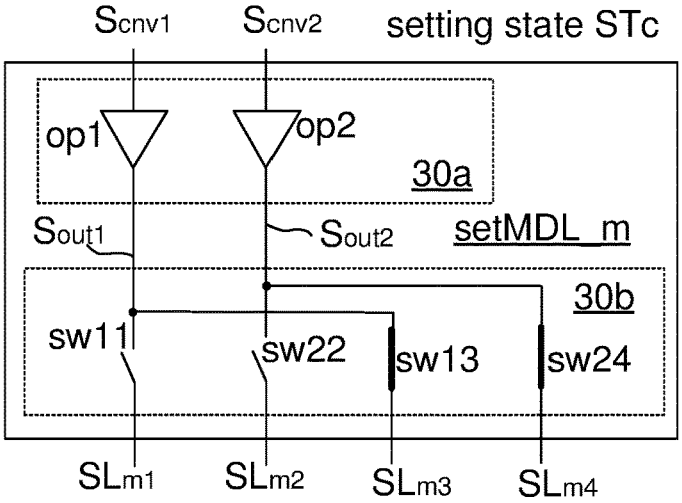

FIGS. 4A-4C are schematic diagrams illustrating different setting states of the channel setting module setMDL_m in FIG. 3. The state of the channel setting module setMDL_m in FIG. 4A is defined as the setting state STa. At the setting state STa, the de-mux switches sw11, sw22 are turned on, and the de-mux switches sw13, sw24 are turned off. Therefore, the source line $SL_{m1}$ receives the output voltage $S_{out1}$ through conduction of the de-mux switch sw11, and the source line $SL_{m2}$ receives the output voltage $S_{out2}$ through conduction of the de-mux switch sw22. Meanwhile, the source lines $SL_{m3}$, $SL_{m4}$ are floating because the de-mux switches sw13, sw24 are turned off.

The state of the channel setting module setMDL_m in FIG. 4B is defined as the setting state STb. At the setting state STb, the de-mux switches sw11, sw24 are turned off, and the de-mux switches sw22, sw13 are turned on. Therefore, the source line $SL_{m2}$ receives the output voltage $S_{out2}$ through conduction of the de-mux switch sw22, and the source line $SL_{m3}$ receives the output voltage $S_{out1}$ through conduction of the de-mux switch sw13. Meanwhile, the source lines $SL_{m1}$, $SL_{m4}$ are floating because the de-mux switches sw11, sw24 are turned off.

The state of the channel setting module setMDL_m in FIG. 4C is defined as the setting state STc. At the setting state STc, the de-mux switches sw11, sw22 are turned off, and the de-mux switches sw13, sw24 are turned on. Therefore, the source line $SL_{m3}$ receives the output voltage $S_{out1}$ through conduction of the de-mux switch sw13, and the source line $SL_{m4}$ receives the output voltage $S_{out2}$ through conduction of the de-mux switch sw24. Meanwhile, the source lines $SL_{m1}$, $SL_{m2}$ are floating because switches sw11, sw22 are turned off.

In the specification, the switch-setting signals $S_{sw}$ are labeled with symbols of their corresponding de-mux switches. For example, the switch-setting signals $S_{sw11}$, $S_{sw22}$, $S_{sw13}$, $S_{sw24}$ are respectively utilized for controlling de-mux switches sw11, sw22, sw13, sw14. The de-mux switches sw11, sw22, sw13, sw14 of the channel setting module setMDL_m in FIGS. 4A-4C are summarized in Table 2.

TABLE 2

| de-mux switches | operational amplifier being electrically connected | source line being electrically connected | FIG. 4A (setting state STa) | FIG. 4B (setting state STb) | FIG. 4C (setting state STc) |
|---|---|---|---|---|---|
| sw11 | op1 | $SL_{m1}$ | ON | OFF | OFF |
| sw22 | op2 | $SL_{m2}$ | ON | ON | OFF |
| sw13 | op1 | $SL_{m3}$ | OFF | ON | ON |
| sw24 | op2 | $SL_{m4}$ | OFF | OFF | ON |

The de-mux switches sw11, sw22, sw13, sw24 are controlled in a time-division manner. The actual control sequences of the de-mux switches sw11, sw22, sw13, sw24 are different, based on different embodiments. In the specification, the first embodiment (FIG. 5) is related to the setting states STa, STb, STc (FIGS. 4A, 4B, and 4C), and the second embodiment (FIG. 6) is related to the setting states STa, STc (FIGS. 4A and 4C).

To illustrate the control methods according to the present disclosure, waveforms are utilized to represent how the signals are controlled. Please note that the voltage levels, amplitudes, and polarities of the waveforms are shown for illustration purposes only, and they might be varied in practical applications.

First Embodiment

Figure 5:
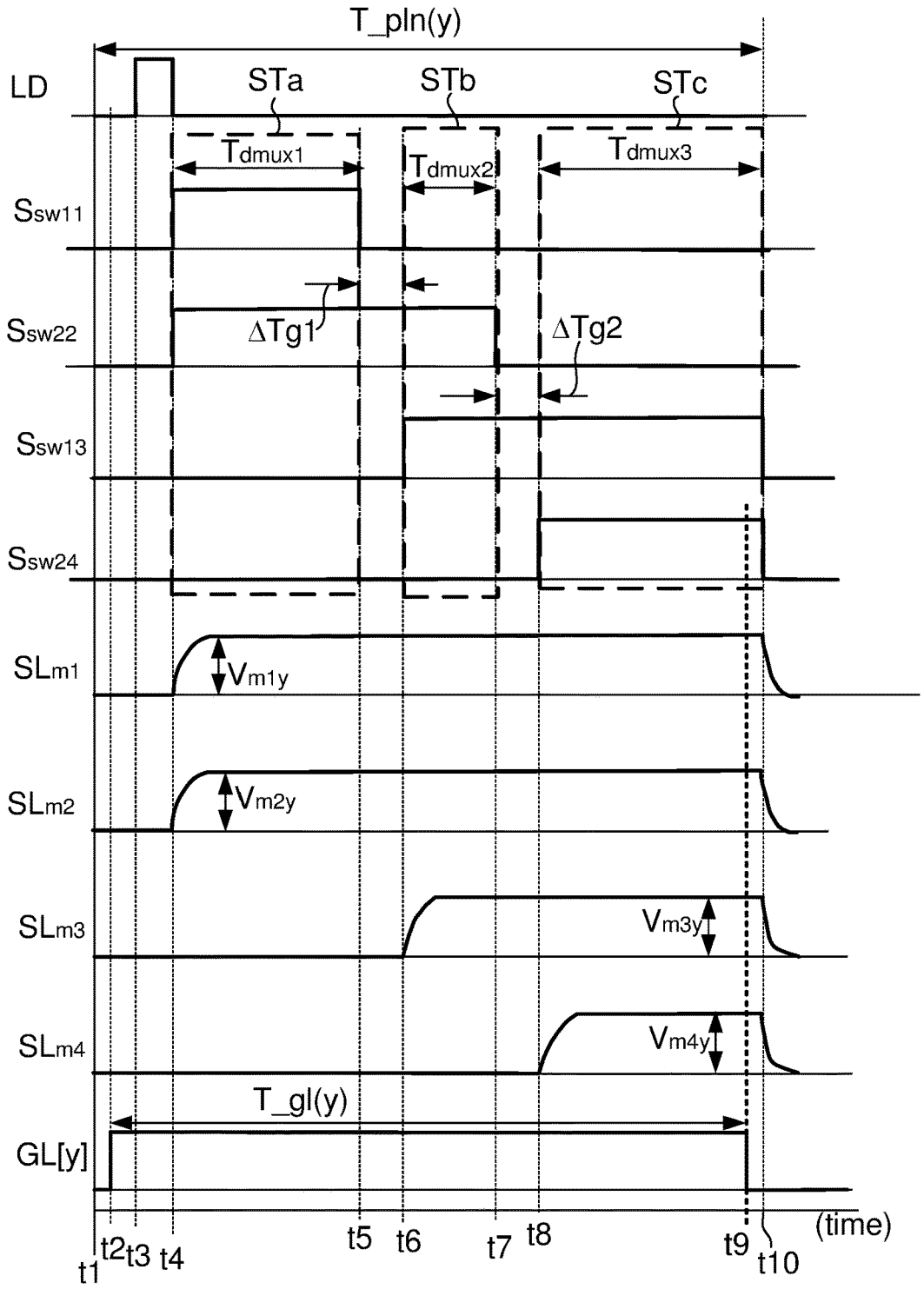
FIG. 5 is a waveform diagram illustrating the operation of the channel setting module setMDL_m, according to the first embodiment of the present disclosure.

FIG. 5 is a waveform diagram illustrating the operation of the channel setting module setMDL_m, according to the first embodiment of the present disclosure. In FIG. 5, the horizontal line duration T_pln(y) is between time point t1 and time point t10, and the gate pulse duration T_gl(y) is between time point t2 and time point t9.

The gate pulse of the gate line GL[y] is utilized to enable the pixels of the y-th row. In the specification, the gate pulse is assumed to be a positive pulse, but it might be a negative pulse in some applications.

In FIG. 5, the loading signal LD, the switch-setting signals $S_{sw11}$, $S_{sw22}$, $S_{sw13}$, $S_{sw24}$ for respectively controlling the de-mux switches sw11, sw22, sw13, sw24, potentials of the source lines $SL_{m1}$, $SL_{m2}$, $SL_{m3}$, $SL_{m4}$, and the gate line GL[y] are shown. Please refer to FIGS. 3, 4A, 4B, 4C, and 5 together.

Between time point t3 and time point t4, the loading signal LD maintains at the on-level. That is, the loading signal LD generates a loading pulse between teme point t3 and time point t4. The loading signal LD is a global signal sent to all channel setting modules setMDL_1~setMDL_M. In response to the loading pulse, the second stage latches L2*a*, L2*b* respectively receives the pre-data $S_{pre1}$, $S_{pre2}$ from the first stage latches L1*a*, L1*b*. Moreover, the operational amplifiers op1, op2 starts to amplify the converted signals $S_{cnv1}$, $S_{cnv2}$, and generate output voltages $S_{out1}$, $S_{out2}$ accordingly. The loading signal LD transits from the on-level to the off-level at time point t4.

At time point t4, the switch-setting signal $S_{sw11}$ transits from the off-level to the on-level. The switch-setting signal $S_{sw11}$ transits from the on-level to the off-level at time point t5. Therefore, the de-mux switch sw11, being controlled by the switch-setting signal $S_{sw11}$, is turned on between time point t4 and time point t5.

At time point t4, the switch-setting signal $S_{sw22}$ transits from the off-level to the on-level. The switch-setting signal $S_{sw22}$ transits from the on-level to the off-level at time point t7. Therefore, the de-mux switch sw22, being controlled by the switch-setting signal $S_{sw22}$, is turned on between time point t4 and time point 7.

At time point t6, the switch-setting signal $S_{sw13}$ transits from the off-level to the on-level. The switch-setting signal $S_{sw13}$ transits from the on-level to the off-level at time point t10. Between time point t6 and time point t10, the switch-setting signal $S_{sw13}$ remains at the on-level. Therefore, the de-mux switch sw13, being controlled by the switch-setting signal $S_{sw13}$, is turned on between time point t6 and time point t10.

At time point t8, the switch-setting signal $S_{sw24}$ transits from the off-level to the on-level. The switch-setting signal $S_{sw24}$ transits from the on-level to the off-level at time point t10. Therefore, the de-mux switch sw24, being controlled by the switch-setting signal $S_{sw24}$, is turned on between time point t8 and time point t0. The waveforms of the switch-setting signals $S_{sw11}$, $S_{sw22}$, $S_{sw13}$, $S_{sw24}$ described above result in the following potential changes of the source lines $SL_{m1}$, $SL_{m2}$, $SL_{m3}$, $SL_{m4}$.

Between time point t4 and time point t5 (the de-multiplexed duration $T_{dmux1}$), the channel setting module setMDL_m is at the setting state STa (FIG. 4A). At time point t4, the source line $SL_{m1}$ starts to increase until the pixel voltage $V_{m1y}$, and the source line $SL_{m2}$ starts to increase until the pixel voltage $V_{m2y}$. Between time point t4 and time point t5, the source line $SL_{m1}$ is continuously biased by the output voltage $S_{out1}$ and maintains at the pixel voltage $V_{m1y}$, and the source line $SL_{m2}$ is continuously biased by the output voltage $S_{out2}$ and maintains at the pixel voltage $V_{m2y}$.

Between time point t5 and time point t6 (gap duration ΔTg1), the channel setting module setMDL_m is at a transition state between the setting state STa and the setting state STb. In the transition state, the de-mux switch sw11, sw13, sw24 are turned off because the switch-setting signals $S_{sw11}$, $S_{sw13}$, $S_{sw24}$ are at the off-level, and the de-mux switch sw22 is turned on because the switch-setting signal $S_{sw22}$ is at the on-level. Therefore, the source lines $SL_{m1}$, $SL_{m3}$, $SL_{m4}$ are floating, and the source line $SL_{m2}$ is biased.

Although the source line $SL_{m1}$ stops receiving the output voltage $S_{out1}$ after time point t5, the potential of the source line $SL_{m1}$ remains at the pixel voltage $V_{m1y}$ because the potential of its adjacent source line $SL_{m2}$ remains constant between time point t5 and time point t7. That is, as there is no significant change of the potential of the source line $SL_{m2}$ by the time the source line $SL_{m1}$ stops receiving the output voltage $S_{out1}$, the potential of the floating source line $SL_{m1}$ can remain unchanged.

Between time point t6 and time point t7 (the de-multiplexed duration $T_{dmux2}$), the channel setting module setMDL_m is at the setting state STb (FIG. 4B). At time point t6, the source line $SL_{m3}$ starts to increase until the pixel voltage $V_{m3y}$. Between time point t6 and time point t10, the source line $SL_{m3}$ is continuously biased by the output voltage $S_{out1}$ and maintains at the pixel voltage $V_{m3y}$.

Between time point t7 and time point t8 (the gap duration ΔTg2), the channel setting module setMDL_m is at a transition state between the setting state STb and the setting state STc. In the transition state, the de-mux switch sw11, sw22, sw24 are turned off because the switch-setting signals $S_{sw11}$, $S_{sw22}$, $S_{sw24}$ are at the off-level, and the de-mux switch sw13 is turned on because the switch-setting signal $S_{sw13}$ is at the on-level. Therefore, the source lines $SL_{m1}$, $SL_{m2}$, $SL_{m4}$ are floating, and the source line $SL_{m3}$ is biased.

The source line $SL_{m2}$ has two adjacent source lines $SL_{m1}$, $SL_{m3}$. The source line $SL_{m1}$ is floating by the time the source line $SL_{m2}$ stops receiving the output voltage $S_{out2}$. Therefore, the potential of the source line $SL_{m1}$ does not affect the potential of the source line $SL_{m2}$. Although the source line $SL_{m2}$ stops receiving the output voltage $S_{out2}$ after time point t7, the potential of the source line $SL_{m2}$ remains at the pixel voltage $V_{m2y}$ because the potential of the source line adjacent to the source line $SL_{m2}$ (that is, the source line $SL_{m3}$) remains unchanged between time point t7 and time point t8. That is, as there is no sudden change of the source line $SL_{m3}$ by the time the source line $SL_{m2}$ stops receiving the output voltage $S_{out2}$, the potential of the floating source line $SL_{m2}$ can remain unchanged. Accordingly, none of the potentials of the source lines $SL_{m1}$, $SL_{m3}$ would affect the potential of the source line $SL_{m2}$.

Between time point t8 and time point t10 (the de-multiplexed duration $T_{dmux3}$), the channel setting module setMDL_m is at the setting state STc (FIG. 4C). At time point t8, the source line $SL_{m4}$ starts to increase until the pixel voltage $V_{m4y}$. Between time point t8 and time point t10, the source line $SL_{m4}$ is continuously biased by the output voltage $S_{out2}$ and maintains at the pixel voltage $V_{m3y}$.

As shown in FIG. 5, when the gate pulse duration T_gl(y) ends at time point t9, the potentials of the source lines $SL_{m1}$, $SL_{m2}$, $SL_{m3}$, $SL_{m4}$ are respectively equivalent to the pixel voltages $V_{m1y}$, $V_{m2y}$, $V_{m3y}$, $V_{m4y}$. As the pixel voltages $V_{m1y}$, $V_{m2y}$, $V_{m3y}$, $V_{m4y}$ respectively correspond luminous intensities of the pixels $pxl_{m1y}$, $pxl_{m2y}$, $pxl_{m3y}$, $pxl_{m4y}$, the luminous intensities of the pixels $pxl_{m1y}$, $pxl_{m2y}$, $Pxl_{m3y}$, $pxl_{m4y}$ are not affected by the coupling effects.

In the first embodiment, the de-multiplexed durations $T_{dmux1}$, $T_{dmux3}$ are mainly used for providing output voltages $S_{out1}$, $S_{out2}$, $S_{out3}$, $S_{out4}$ to the source lines $SL_{m1}$, $SL_{m2}$, $SL_{m3}$, $SL_{m4}$, and the de-multiplexed duration $T_{dmux2}$ is mainly used for eliminating the potential coupling effect. During the de-multiplexed duration $T_{dmux2}$, potential changes of the source lines $SL_{m1}$, $SL_{m3}$ are specially managed to avoid the occurrence of the coupling effects. The length of the de-multiplexed duration $T_{dmux1}$ is longer than the length of the de-multiplexed duration $T_{dmux2}$, and the de-multiplexed duration $T_{dmux3}$ is longer than the length of the de-multiplexed duration $T_{dmux2}$. In some applications, the length of the de-multiplexed duration $T_{dmux1}$ is equivalent to the length of the de-multiplexed duration $T_{dmux3}$. The state-changing sequence of the channel setting module setMDL_m in the first embodiment is summarized in Table 3.

TABLE 3

| duration | state of the channel setting module setMDL_m | biased source lines | floating source lines |
|---|---|---|---|
| de-multiplexed duration $T_{dmux1}$ | setting state STa (FIG. 4A) | $SL_{m1}$, $SL_{m2}$ | $SL_{m3}$, $SL_{m4}$ |
| gap duration ΔTg1 | transition state | $SL_{m2}$ | $SL_{m1}$, $SL_{m3}$, $SL_{m4}$ |
| de-multiplexed duration $T_{dmux2}$ | setting state STb (FIG. 4B) | $SL_{m2}$, $SL_{m3}$ | $SL_{m1}$, $SL_{m4}$ |
| gap duration ΔTg2 | transition state | $SL_{m3}$ | $SL_{m1}$, $SL_{m2}$, $SL_{m4}$ |
| de-multiplexed duration $T_{dmux3}$ | setting state STc (FIG. 4C) | $SL_{m3}$, $SL_{m4}$ | $SL_{m1}$, $SL_{m2}$ |

Second Embodiment

Figure 6:
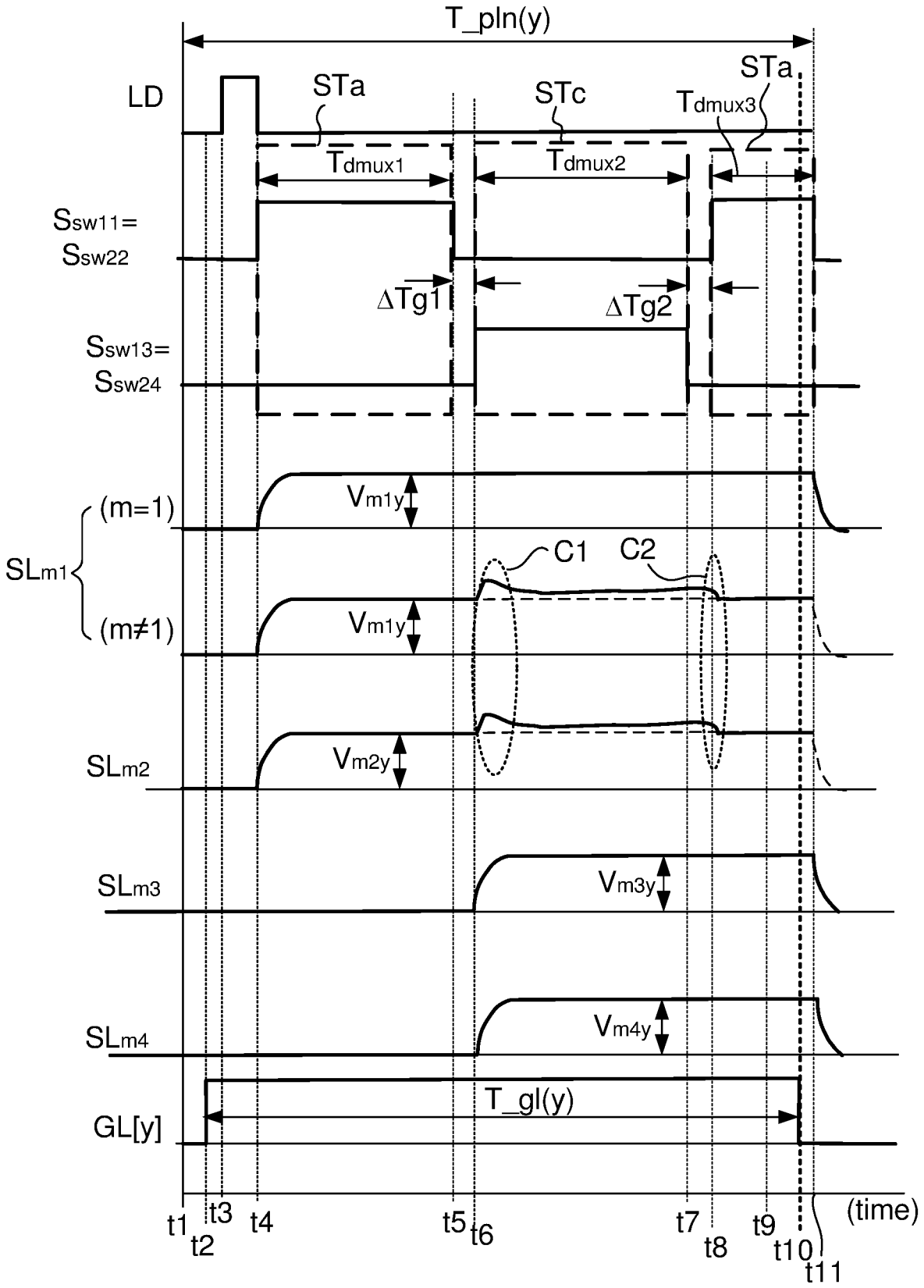
FIG. 6 is a waveform diagram illustrating the operation of the channel setting module setMDL_m, according to the second embodiment of the present disclosure.

FIG. 6 is a waveform diagram illustrating the operation of the channel setting module setMDL_m, according to the second embodiment of the present disclosure. In FIG. 6, the horizontal line duration T_pln(y) is between time point t1 and time point t11, and the gate pulse duration T_gl(y) is between time point t2 and time point t10.

In FIG. 6, the loading signal LD, the switch-setting signals $S_{sw11}$, $S_{sw22}$, $S_{sw13}$, $S_{sw24}$ for respectively controlling the de-mux switches sw11, sw22, sw13, sw24, potentials of source lines $SL_{m1}$, $SL_{m2}$, $SL_{m3}$, $SL_{m4}$, and the gate line GL[y] are shown. Please refer to FIGS. 3, 4A, 4C, and 6 together.

Between time point t3 and time point t4, a loading pulse is generated. In response to the loading pulse, the second stage latches L2*a*, L2*b* receives the pre-data $S_{pre1}$, $S_{pre2}$ from the first stage latches L1*a*, L1*b*, and the level shifters pLVSHT, nLVSHT, and the converting circuits pDAC, nDAC also proceed their operations. Then, at time point t4, the operational amplifiers op1, op2 start to amplify the converted signals $S_{cnv1}$, $S_{cnv2}$, and generate the output voltages $S_{out1}$, $S_{out2}$ accordingly.

At time point t4, the switch-setting signals $S_{sw11}$, $S_{sw22}$ transit from the off-level to the on-level. The switch-setting signal $S_{sw11}$, $S_{sw22}$ transit from the on-level to the off-level at time point t5. Therefore, the de-mux switches sw11, sw22 are turned on between time point t4 and time point t5.

At time point t6, the switch-setting signals $S_{sw13}$, $S_{sw24}$ transit from the off-level to the on-level. The switch-setting signals $S_{sw13}$, $S_{sw24}$ transit from the on-level to the off-level at time point t7. Therefore, the de-mux switches sw13, sw24 are turned on between time point t6 and time point t7.

At time point t8, the switch-setting signals $S_{sw11}$, $S_{sw22}$ transit from the off-level to the on-level. The switch-setting signals $S_{sw11}$, $S_{sw22}$ transit from the on-level to the off-level at time point t11. Therefore, the de-mux switches sw11, sw22 are turned on between time point t8 and time point t11. The above-described of the waveforms of the switch-setting signals $S_{sw11}$, $S_{sw22}$, $S_{sw13}$, $S_{sw24}$ result in the following potential changes of the source lines $SL_{m1}$, $SL_{m2}$, $SL_{m3}$, $SL_{m4}$, as described above.

Between time point t4 and time point t5 (the de-multiplexed duration $T_{dmux1}$), the channel setting module setMDL_m is at the setting state STa (FIG. 4A). At time point t4, the source line $SL_{m1}$ starts to increase until the pixel voltage $V_{m1y}$, and the source line $SL_{m2}$ starts to increase until the pixel voltage $V_{m2y}$. Between time point t4 and time point t5, the source line $SL_{m1}$ is continuously biased by the output voltage $S_{out1}$, and maintains at the pixel voltage $V_{m1y}$, and the source line $SL_{m2}$ is continuously biased by the output voltage $S_{out2}$ and maintains at the pixel voltage $V_{m2y}$.

Between time point t5 and time point t6 (the gap duration ΔTg1), the channel setting module setMDL_m is at a transition state between the setting state STa and the setting state STc. In the transition state, the de-mux switches sw11, sw22, sw13, sw24 are all turned off because the switch-setting signals $S_{sw11}$, $S_{sw22}$, $S_{sw13}$, $S_{sw24}$ are at the off-level.

Between time point t6 and time point t7 (the de-multiplexed duration $T_{dmux2}$), the channel setting module setMDL_m is at the setting state STc (FIG. 4C). During the de-multiplexed duration $T_{dmux2}$, the potential of the source line $SL_{m1}$ can be slightly higher than or equivalent to the pixel voltage $V_{m1y}$, details of which are illustrated later. Between time point t6 and time point 7. The dotted circle C1 shows that the potential of the source line $SL_{m2}$ has overshoot, caused by the source line $SL_{m3}$, when the potential of the source line $SL_{m3}$ rises at time point t6. The potential of the source line $SL_{m2}$ increases to a value slightly higher than the pixel voltage $V_{m3y}$ between time point t6 and time point t7. At time point t6, the source line $SL_{m3}$ starts to increase until the pixel voltage $V_{m3y}$, and the source line $SL_{m4}$ starts to increase until the pixel voltage $V_{m4y}$. During the de-multiplexed duration $T_{dmux2}$, the source line $SL_{m3}$ is continuously biased by the output voltage $S_{out1}$ and maintains at the pixel voltage $V_{m3y}$, and the source line $SL_{m4}$ is continuously biased by the output voltage $S_{out2}$ and maintains at the pixel voltage $V_{m4y}$.

Between time point t7 and time point t8 (the gap duration ΔTg2), the channel setting module setMDL_m is at a transition state between the setting state STc and the setting state STa. In the transition state, the de-mux switch sw11, sw22, sw13, sw24 are all turned off because the switch-setting signals $S_{sw11}$, $S_{sw22}$, $S_{sw13}$, $S_{sw24}$ are at the off-level. During the gap duration ΔTg2, the potential of the source line $SL_{m1}$ is slightly higher than or equivalent to the pixel voltage $V_{m1y}$, the potential of the source line $SL_{m2}$ is slightly higher than the pixel voltage $V_{m2y}$, the potential of the source line $SL_{m3}$ is equivalent to the pixel voltage $V_{m3y}$, and the potential of the source line $SL_{m4}$ is equivalent to the pixel voltage $V_{m4y}$.

Between time point t8 and time point t11 (the de-multiplexed duration $T_{dmux3}$), the channel setting module setMDL_m is at the setting state STa (FIG. 4A). During the de-multiplexed duration $T_{dmux3}$, the source line $SL_{m1}$ is continuously biased by the output voltage $S_{out1}$ and maintains at the pixel voltage $V_{m1y}$, and the source line $SL_{m2}$ is continuously biased by the output voltage $S_{out2}$ and maintains at the pixel voltage $V_{m2y}$. The dotted circle C2 shows that the potential of the source line $SL_{m2}$ and returns to the pixel voltage $V_{m2y}$ soon after time point t8. The dropping of the potential of the source line $SL_{m2}$, soon after time point t8, results from that the de-mux switch sw22 is turned on, and the source line $SL_{m2}$ is biased again since time point t8.

As shown in FIG. 6, when the gate pulse duration T_gl(y) ends at time point t10, the potentials of the source lines $SL_{m1}$, $SL_{m2}$, $SL_{m3}$, $SL_{m4}$ are respectively equivalent to the pixel voltages $V_{m1y}$, $V_{m2y}$, $V_{m3y}$, $V_{m4y}$. Therefore, the luminous intensities of the pixels $pxl_{m1y}$, $pxl_{m2y}$, $pxl_{m3y}$, $pxl_{m4y}$ are not affected by the coupling effects.

In FIG. 6, the source lines $SL_{m1}$ is corresponding to two waveforms, depending on the value of m. When m=1, the source line $SL_{m1}$ is the source line SL[1] of the display panel, and only source line SL[2] is adjacent to the source line SL[1]. As the de-mux switch sw11, sw22 are switched simultaneously, the potentials of the source lines SL[1], SL[2] change synchronously, and the potential of the source line SL[1] is not affected by the potential changes of the source line SL[2]. Therefore, the potential of the source line $SL_{m1}$ does not have overshoot when m=1.

When m≠1, the source line $SL_{m1}$ has two adjacent source lines, including the source line $SL_{m2}$ in the channel setting module setMDL_m and the source line $SL_{m4}$ in the channel setting module setMDL_(m−1). As the source lines $SL_{m1}$, $SL_{m2}$ in the channel setting module setMDL_m receive the output voltages $S_{out1}$, $S_{out2}$ synchronously, the source line $SL_{m2}$ does not affect the potential of the source line $SL_{m1}$. However, the source line $SL_{m1}$ might be affected by the potential of the source line $SL_{m4}$ in the channel setting module setMDL_(m−1) when m≠1. Therefore, when m≠1, the potential changes of the source line $SL_{m1}$ are similar to those of the source line $SL_{m2}$.

In the second embodiment, the de-multiplexed duration $T_{dmux1}$, $T_{dmux2}$ is mainly used for providing pixel voltages $V_{m1y}$, $V_{m2y}$ to the source lines $SL_{m1}$, $SL_{m2}$, the de-multiplexed duration $T_{dmux2}$ is mainly used for providing pixel voltages $V_{m3y}$, $V_{m4y}$ to the source lines $SL_{m3}$, $SL_{m4}$, and the de-multiplexed duration $T_{dmux2}$ is mainly used for compensating the side effect of the coupling. Therefore, the potential of the source lines $SL_{m1}$, $SL_{m2}$ are recovered to the pixel voltages $V_{m1y}$, $V_{m2y}$ in the de-multiplexed duration $T_{dmux3}$, although their potentials are affected in the de-multiplexed duration $T_{dmux2}$. The length of the de-multiplexed duration $T_{dmux1}$ is longer than the length of the de-multiplexed duration $T_{dmux2}$, and the de-multiplexed duration $T_{dmux2}$ is longer than the length of the de-multiplexed duration $T_{dmux3}$. In some applications, the length of the de-multiplexed duration $T_{dmux1}$ is equivalent to the length of the de-multiplexed duration $T_{dmux2}$. The state-changing sequence of the channel setting module setMDL_m in the second embodiment is summarized in Table 4.

TABLE 4

| duration | state of the channel setting module setMDL_m | biased source lines | floating source lines |
|---|---|---|---|
| de-multiplexed duration $T_{dmux1}$ | setting state STa (FIG. 4A) | $SL_{m1}$, $SL_{m2}$ | $SL_{m3}$, $SL_{m4}$ |
| gap duration ΔTg1 | transition state | not available | $SL_{m1}$, $SL_{m2}$, $SL_{m3}$, $SL_{m4}$ |
| de-multiplexed duration $T_{dmux2}$ | setting state STc (FIG. 4C) | $SL_{m3}$, $SL_{m4}$ | $SL_{m1}$, $SL_{m2}$ |
| gap duration ΔTg2 | transition state | not available | $SL_{m1}$, $SL_{m2}$, $SL_{m3}$, $SL_{m4}$ |
| de-multiplexed duration $T_{dmux3}$ | setting state STa (FIG. 4A) | $SL_{m1}$, $SL_{m2}$ | $SL_{m3}$, $SL_{m4}$ |

The OLED display panels and the LCD panels are widely used in display devices. The LCD panels use polarity inversion, for example, dot inversion, line inversion, column inversion, frame inversion, and so forth, to prevent damages. Therefore, the polarity inversion function needs to be concerned for the source drivers of LCD panels.

Figure 7:
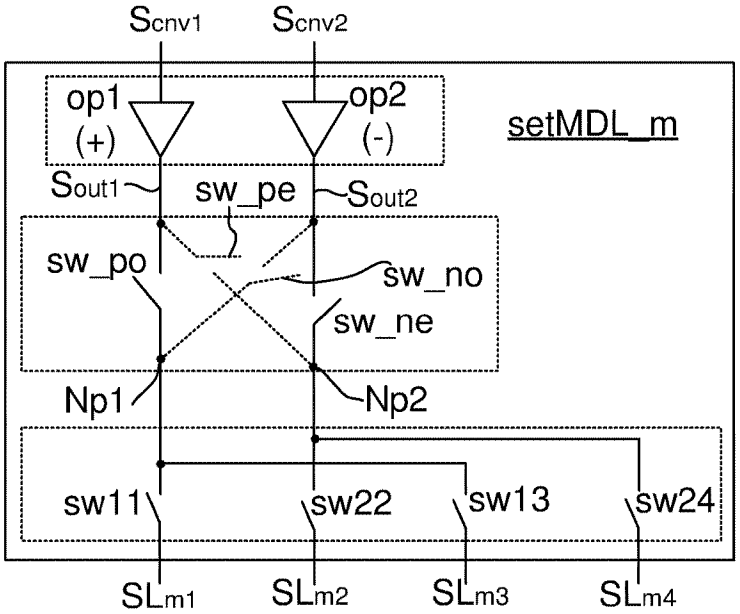
FIG. 7 is a schematic diagram illustrating that the channel setting module setMDL_m is applied to an LCD panel.

FIG. 7 is a schematic diagram illustrating that the channel setting module setMDL_m is applied to an LCD panel. For the LCD panels, the channel setting module setMDL_m may further include polarity control switches sw_po, sw_pe, sw_no, sw_ne. The polarity control switches sw_po, sw_pe, sw_no, sw_ne are classified into two groups, a group of the polarity control switches (sw_po, sw_ne) is shown in solid lines, and the other group of the polarity control switches (sw_pe, sw_no) is shown in dotted lines. The operational amplifier op1 provides output voltage $S_{out1}$ having positive polarity (+), and the operational amplifier op2 provides output voltage $S_{out2}$ having negative polarity (−).

Shown in solid lines, the polarity control switches sw_po, sw_ne are parallel to each other. The polarity control switch sw_po is electrically connected to the operational amplifier op1 and the polarity terminal Np1. The polarity control switch sw_ne is electrically connected to the operational amplifier op2 and the polarity terminal Np2. The polarity control switches sw_po, sw_ne are turned on when the polarity setting signal PL is at the on-level (PL=1), and the polarity control switches sw_po, sw_ne are turned off when the polarity setting signal PL is at the off-level (PL=0).

Shown in dotted lines, the polarity control switches sw_pe, sw_no are cross-coupled. The polarity control switch sw_pe is electrically connected to the operational amplifier op1 and the polarity terminal Np2. The polarity control switch sw_no is electrically connected to the operational amplifier op2 and the polarity terminal Np1. The polarity control switches sw_pe, sw_no are turned off when the polarity setting signal PL is at the on-level (PL=1), and the polarity control switches sw_pe, sw_no are turned on when the polarity setting signal PL is at the off-level (PL=0).

Figure 8A:
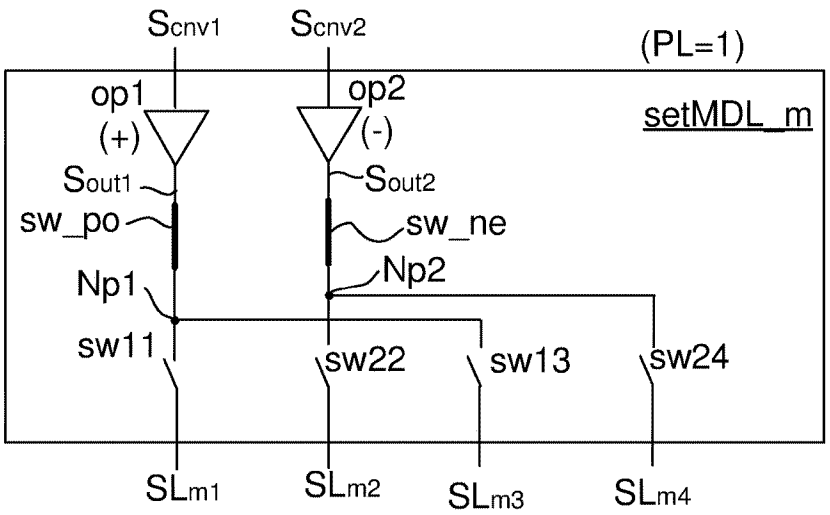
FIG. 8A is a schematic diagram illustrating the setting of the polarity control switches when the polarity setting signal PL is at the on-level (PL=1).

FIG. 8A is a schematic diagram illustrating the settings of the polarity control switches when the polarity setting signal PL is at the on-level (PL=1). In FIG. 8A, only the polarity control switches sw_po, sw_ne are turned on. Thus, the potential of the polarity terminal Np1 equals to the output voltage $S_{out1}$, through conduction of the polarity control switch sw_po, and the potential of the polarity terminal Np2 equals to the output voltage $S_{out2}$ through conduction of the polarity control switch sw_ne.

Figure 8B:
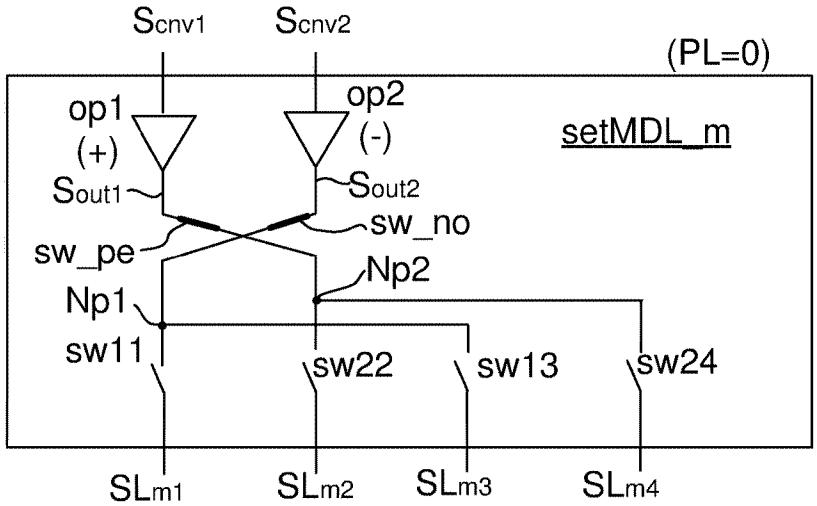
FIG. 8B is a schematic diagram illustrating the setting of the polarity control switches when the polarity setting signal PL is at the off-level (PL=0).

FIG. 8B is a schematic diagram illustrating the setting of the polarity control switches when the polarity setting signal PL is at the off-level (PL=0). In FIG. 8B, only the polarity control switches sw_pe, sw_no are turned on. Thus, the potential of the polarity terminal Np1 equals to the output voltage $S_{out2}$ through conduction of the polarity control switch sw_no, and the potential of the polarity terminal Np2 equals to the output voltage $S_{out1}$ through conduction of the polarity control switch sw_pe.

In both FIGS. 8A and 8B, the conduction states of the polarity control switches sw_po, sw_ne, sw_pe, sw_no are merely related to the origins of the polarity terminals Np1, Np2. Whereas, the conduction states of the de-mux switches sw11, sw22, sw13, sw24 are irrelevant to the origins of the polarity terminals Np1, Np2. Alternatively speaking, the control of polarity control switches sw_po, sw_pe, sw_ne, sw_no are independent of the control of the de-mux switches sw11, sw22, sw13, sw24. Therefore, the embodiments, according to the present disclosure, can be applied to the OLED display panels and the LCD panels.

Third Embodiment

Figure 9:
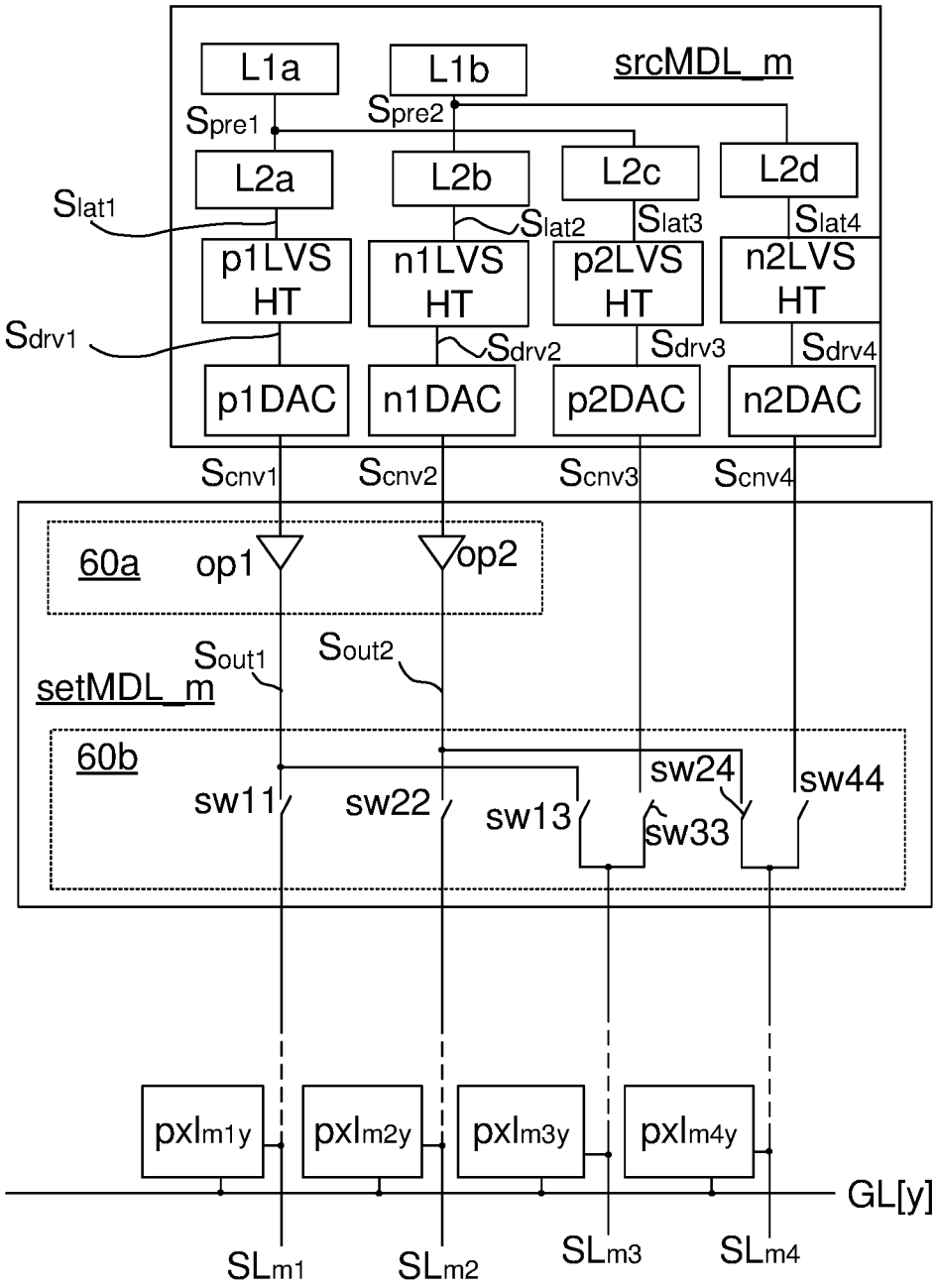
FIG. 9 is a schematic diagram illustrating the design of the channel setting module setMDL_m without polarity switching function according to the third embodiment of the present disclosure.

FIG. 9 is a schematic diagram illustrating the design of the source control module srcMDL_M and the channel setting module setMDL_m without polarity switching function according to the third embodiment of the present disclosure. The internal components of the source control modules srcMDL_m and the channel setting module setMDL_m are respectively illustrated.

The source control modules srcMDL_m includes the first stage latches L1*a*, L1*b*, the second stage latches L2*a*, L2*b*, L2*c*, L2*d*, the level shifters p1LVSHT, n1LVSHT, p2LVSHT, n2LVSHT, and the converting circuits p1DAC, n1DAC, p2DAC, n2DAC.

The second stage latches L2*a*, L2*c* are electrically connected to the first stage latch L1*a*, and the second stage latches L2*b*, L2*d* are electrically connected to the first stage latch L1*b*. The level shifters p1LVSHT, n1LVSH, p2LVSH, n2LVSH are respectively electrically connected to the second stage latches L2*a*, L2*b*, L2*c*, L2*d*. The converting circuits p1DAC, n1DAC, p2DAC, n2DAC are respectively electrically connected to the level shifters p1LVSHT, n1LVSHT, p2LVSHT, n2LVSHT.

The first stage latches L1*a*, L1*b* receive video signals from the timing controller. Then, the first stage latches L1*a*, L1*b* respectively generate pre-data $S_{pre1}$, $S_{pre2}$. Later, the second stage latches L2*a*, L2*b*, L2*c*, L2*d* respectively generate and transmit the latched data $S_{lat1}$, $S_{lat2}$, $S_{lat3}$, $S_{lat4}$ to the level shifters p1LVSHT, n1LVSHT, p2LVSHT, n2LVSHT.

The converting circuits p1DAC, n1DAC, p2DAC, n2DAC respectively receive the driving signals $S_{drv1}$, $S_{drv2}$, $S_{drv3}$, $S_{drv4}$ from the level shifters p1LVSHT, n1LVSHT, p2LVSHT, n2LVSHT, convert the driving signals $S_{drv1}$, $S_{drv2}$, $S_{drv3}$, $S_{drv4}$ to the converted signals $S_{cnv1}$, $S_{cnv2}$, $S_{cnv3}$, $S_{cnv4}$, and transmit the converted signals $S_{cnv1}$, $S_{cnv2}$, $S_{cnv3}$, $S_{cnv4}$ to the channel setting module setMDL_m.

The channel setting module setMDL_m (60) includes a buffer 60*a* and a de-multiplexer switching circuit 60*b*. The buffer 60*a* includes operational amplifiers op1, op2, and the de-multiplexer switching circuit 60*b* includes de-mux switches sw11, sw22, sw13, sw33, sw24, sw44.

The operational amplifier op1 is electrically connected to the converting circuit p1DAC, and the operational amplifier op2 is electrically connected to the converting circuit n1DAC. The converting circuits p1DAC, n1DAC, p2DAC, n2DAC respectively generate the converted signals $S_{cnv1}$, $S_{cnv2}$, $S_{cnv3}$, $S_{cnv4}$. After receiving the converted signals $S_{cnv1}$, the operational amplifier op1 amplifies the converted signal $S_{cnv1}$ to generate the output voltage $S_{out1}$. After receiving the converted signals $S_{cnv2}$, the operational amplifier op2 amplifies the converted signal $S_{cnv2}$ to generate the output voltage $S_{out2}$.

In FIG. 9, two main output channels and two auxiliary output channels can be defined. Each of the main output channels corresponds to a first stage latch, a second stage latch, a level shifter, a converting circuit, and an operational amplifier. Therefore, the first stage latch L1*a*, the second stage latch L2*a*, the level shifter p1LVSHT, the converting circuit p1DAC, and the operational amplifier op1 jointly form one main output channel, and the first stage latch L1*b*, the second stage latch L2*b*, the level shifter n1LVSHT, the converting circuit n1DAC, and the operational amplifier op2 jointly form another main output channel.

Each of the auxiliary output channels corresponds to a first stage latch, a second stage latch, a level shifter, and a converting circuit. Therefore, the first stage latch L1*a*, the second stage latch L2*c*, the level shifter p2LVSHT, and the converting circuit p2DAC jointly form an auxiliary output channel, and the first stage latch L1*b*, the second stage latch L2*d*, the level shifter n2LVSHT, and the converting circuit n2DAC jointly form the other auxiliary output channel.

The internal components and their interconnections in the de-multiplexer switching circuit 60*b* are described. The de-mux switch sw11 is electrically connected to the operational amplifier op1 and the source line $SL_{m1}$, and the de-mux switch sw22 is electrically connected to the operational amplifier op2 and the source line $SL_{m2}$. The de-mux switch sw13 is electrically connected to the operational amplifier op1 and the source line $SL_{m3}$, and the de-mux switch sw33 is electrically connected to the converting circuit p2DAC and the source line $SL_{m3}$. The de-mux switch sw24 is electrically connected to the operational amplifier op2 and the source line $SL_{m4}$, and the de-mux switch sw44 is electrically connected to the converting circuit n2DAC and the source line $SL_{m4}$. In the de-multiplexer switching circuit 60*b*, the de-mux switches sw11, sw13 are related to the main output channel corresponding to the operational amplifier op1, the de-mux switches sw22, sw24 are related to the main output channel corresponding to the operational amplifier op2, the switch sw33 is related to the auxiliary output channel corresponding to the converting circuit p2DAC, and the switch sw44 is related to the auxiliary output channel corresponding to the converting circuit n2DAC.

The pixels, which are disposed at the y-th row and corresponding to the channel setting module setMDL_m, are shown. The pixels $pxl_{m1y}$, $pxl_{m2y}$, $pxl_{m3y}$, $pxl_{m4y}$ are jointly electrically connected to the gate line GL[y], and the pixels $pxl_{m1y}$, $pxl_{m2y}$, $pxl_{m3y}$, $pxl_{m4y}$ are respectively electrically connected to the source lines $SL_{m1}$, $SL_{m2}$, $SL_{m3}$, $SL_{m4}$.

In FIG. 9, the de-mux switches sw11, sw22, sw13, sw33, sw24, sw44 can be classified into two types. The first type of de-mux switches (sw11, sw22, sw13, sw24) is electrically connected to one of the operational amplifiers op1, op2, and one of the source lines $SL_{m1}$, $SL_{m2}$, $SL_{m3}$, $SL_{m4}$. The second type of de-mux switches (sw33, sw44) is electrically connected to one of the converting circuits p2DAC, n2DAC, and one of the source lines $SL_{m3}$, $SL_{m4}$. Alternatively speaking, the first type of de-mux switches (sw11, sw22, sw13, sw24) are corresponding to the main output channels, and the second type of de-mux switches (sw33, sw44) are corresponding to the auxiliary output channels.

The source lines ($SL_{m1}$, $SL_{m2}$, $SL_{m3}$, $SL_{m4}$) in FIG. 9 can also be classified into two types. The first type of source lines ($SL_{m1}$, $SL_{m2}$) only receive output voltages ($S_{out1}$, $S_{out2}$) from the operational amplifiers (op1, op2). The second type of source lines ($SL_{m3}$, $SL_{m4}$) may receive the output voltages ($S_{out1}$, $S_{out2}$) from the operational amplifiers (op1, op2) or receive the converted signals ($S_{cnv1}$, $S_{cnv4}$) from the converting circuits (p2DAC, n2DAC).

The first stage latch L1*a* is corresponding to a main output channel and an auxiliary output channel, and the first stage latch L1*b* is corresponding to the other main output channel and the other auxiliary output channel. The corresponding main output channel and the auxiliary output channel have similar components, except that the auxiliary output channel excludes an operational amplifier.

Figure 10A:
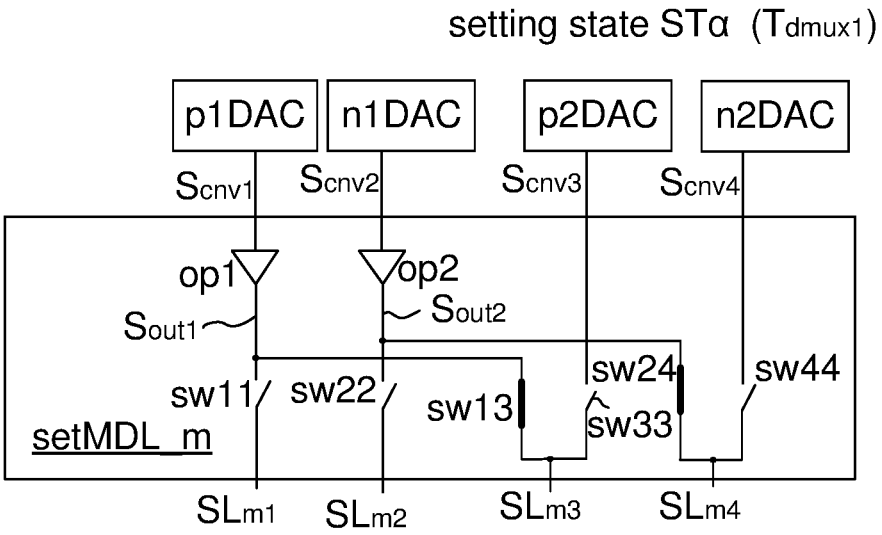
FIGS. 10A and 10B are schematic diagrams illustrating different setting states of the channel setting module setMDL_m in FIG. 9.
Figure 10B:
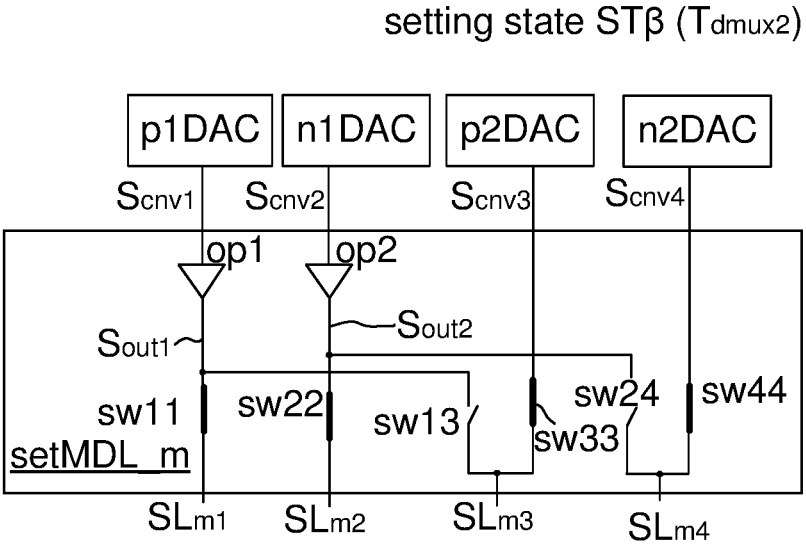

FIGS. 10A and 10B are schematic diagrams illustrating different setting states of the channel setting module setMDL_m circuit in FIG. 9.

The state of the channel setting module setMDL_m in FIG. 10A is defined as the setting state STa. At the setting state STα, the de-mux switches sw13, sw24 are turned on, and the de-mux switches sw11, sw22, sw33, sw44 are turned off. Therefore, the output voltage $S_{out1}$ is supplied to the source line $SL_{m3}$ through conduction of the de-mux switch sw13, and the output voltage $S_{out2}$ is supplied to the source line $SL_{m4}$ through conduction of the de-mux switch sw24. Meanwhile, the source lines $SL_{m1}$, $SL_{m2}$ are floating because the de-mux switches sw11, sw22 are turned off.

The state of the channel setting module setMDL_m in FIG. 10B is defined as the setting state STβ. At the setting state STβ, the de-mux switches sw13, sw24 are turned off, and the de-mux switches sw11, sw22, sw33, sw44 are turned on. Therefore, the output voltage $S_{out1}$ is supplied to the source line $SL_{m1}$ through conduction of the de-mux switch sw11, and the output voltage $S_{out2}$ is supplied to the source line $SL_{m2}$ through conduction of the de-mux switch sw22. Meanwhile, the source line $SL_{m3}$ receives the converted signal $S_{cnv3}$ from the converting circuit p2DAC through conduction of the de-mux switch sw33, and the source line $SL_{m4}$ receives the converted signal $S_{cnv4}$ from the converting circuit n2DAC through conduction of the de-mux switch sw44. That is, while the source lines $SL_{m1}$, $SL_{m2}$ are respectively biased by the output voltages ($S_{out1}$, $S_{out2}$) of the operational amplifiers op1, op2, the converting circuits p2DAC, n2DAC supply supplement charges to the source lines $SL_{m3}$, $SL_{m4}$, respectively. With the supplement charges, the potential of the source lines $SL_{m3}$, $SL_{m4}$ are capable of transiting back to the pixel voltage $V_{m3y}$, $V_{m4y}$ after the instantaneous effects (overshoot and/or undershoot) caused by the coupling.

Figure 11:
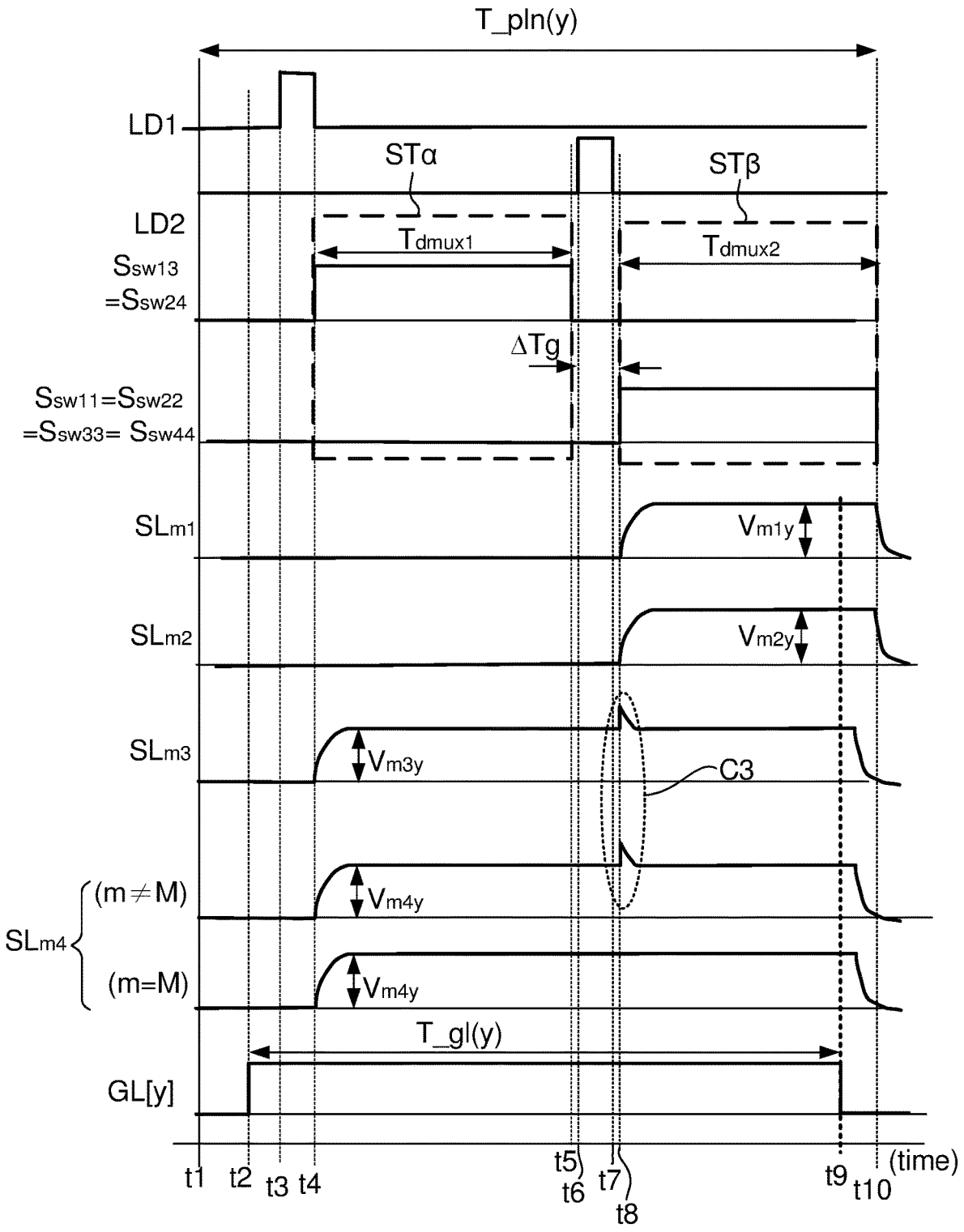
FIG. 11 is a waveform diagram illustrating the operation of the channel setting module setMDL_m in FIG. 9.

FIG. 11 is a waveform diagram illustrating the operation of the channel setting module setMDL_m in FIG. 9. In this embodiment, the source control signal $S_{src_ctl}$ include video signals for the first stage latches L1*a*, L1*b*, loading signals LD1, LD2, and the switch-setting signals $S_{sw13}$, $S_{sw24}$, $S_{sw11}$, $S_{sw22}$, $S_{sw33}$, $S_{sw44}$ for the de-mux switches sw13, sw24, sw11, sw22, sw33, sw44.

In FIG. 11, the horizontal line duration T_pln(y) is between time point t1 and time point t11, and the gate pulse duration T_gl(y) is between time point t2 and time point t10. In FIG. 11, the loading signals LD1, LD2, the switch-setting signals $S_{sw13}$, $S_{sw24}$, $S_{sw11}$, $S_{sw22}$, $S_{sw33}$, $S_{sw44}$ for respectively controlling the de-mux switches sw13, sw24, sw11, sw22, sw33, sw44, the potentials of the source lines $SL_{m1}$, $SL_{m2}$, $SL_{m3}$, $SL_{m4}$, and the gate line GL[y] are shown. Please refer to FIGS. 9, 10A, 10B, and 11 together.

According to the third embodiment, two loading signals LD1, LD2 are adopted. The loading signal LD1 maintains at the on-level between time point t3 and time point t4, and the loading signal LD2 maintains at the on-level between time point t6 and time point t7. That is, two loading pulses are generated.

After receiving the loading pulse of the loading signal LD1, the channel setting module setMDL_m starts to enter the de-multiplexed duration $T_{dmux1}$ at time point t4. During the de-multiplexed duration $T_{dmux1}$, the second stage latches L2*a*, L2*c* simultaneously acquire the pre-data $S_{pre1}$ from the first stage latch L1*a*, and the second stage latches L2*b*, L2*d* simultaneously acquire the pre-data $S_{pre2}$ from the first stage latch L1*b*. Then, the second stage latches L2*a*, L2*b*, L2*c*, L2*d* respectively generate the latched data $S_{lat1}$, $S_{lat2}$, $S_{lat3}$, $S_{lat4}$, and the level shifters p1LVSHT, n1LVSHT, p2LVSHT, n2LVSHT respectively generate the driving signals $S_{drv1}$, $S_{drv2}$, $S_{drv3}$, $S_{drv4}$. The converting circuits p1DAC, n1DAC generate the converted signals $S_{cnv1}$, $S_{cnv2}$, and the operational amplifiers op1, op2 start to amplify the converted signals $S_{cnv1}$, $S_{cnv2}$ to generate the output voltages $S_{out1}$, $S_{out2}$ accordingly. Please note that the converted signals $S_{cnv3}$, $S_{cnv4}$ are not amplified by any of the operational amplifiers op1, op2.

In the de-multiplexed duration $T_{dmux1}$, the origins and generation paths of the converted signals $S_{cnv1}$, $S_{cnv3}$ are similar, so as the origins and generation paths of the converted signals $S_{cnv2}$, $S_{cnv4}$. Both the converted signals $S_{cnv1}$, $S_{cnv3}$ are generated based on the pre-data $S_{pre1}$, with further processing of a second stage latch (L2*a*/L2*c*), a level shifter (p1LVSHT/p2LVSHT), and a converting circuit (p1DAC/p2DAC). Both the converted signals $S_{cnv2}$, $S_{cnv4}$ are generated based on the pre-data $S_{pre2}$, with further processing of a second stage latch (L2*b*/L2*d*), a level shifter (n1LVSHT/n2LVSHT), and a converting circuit (n1DAC/n2DAC).

After receiving the loading pulse of the loading signal LD2, the channel setting module setMDL_m starts to enter the de-multiplexed duration $T_{dmux2}$ at time point t8. During the de-multiplexed duration $T_{dmux2}$, the second stage latches L2*a*, L2*b* respectively acquires the pre-data $S_{pre1}$, $S_{pre2}$ from the first stage latches L1*a*, L2*b*. Then, the second stage latches L2*a*, L2*b* respectively generate the latched data $S_{lat1}$, $S_{lat2}$, and the level shifters p1LVSHT, n1LVSHT respectively generate the driving signals $S_{drv1}$, $S_{drv2}$. The converting circuits p1DAC, n1DAC generate the converted signals $S_{cnv1}$, $S_{cnv2}$, and the operational amplifiers op1, op2 start to amplify the converted signals $S_{cnv1}$, $S_{cnv2}$ to generate the output voltages $S_{out1}$, $S_{out2}$ accordingly. Please note that the second stage latches L2*c*, L2*d*, the level shifters p2LVSHT, n2LVSHT, and the converting circuits p2DAC, n2DAC do not operate in response to the loading pulse of the loading signal LD2. Consequentially, the converted signals $S_{cnv3}$, $S_{cnv4}$ are not updated during the de-multiplexed duration $T_{dmux2}$.

In the third embodiment, the video signals received by the first stage latches L1*a*, L1*b* are corresponding to different pixels, depending on the de-multiplexed durations $T_{dmux1}$, $T_{dmux2}$. In the de-multiplexed duration $T_{dmux1}$, the first stage latches L1*a*, L1*b* receive the video signals corresponding to the pixels $pxl_{m3y}$, $pxl_{m4y}$, respectively. In the de-multiplexed duration $T_{dmux2}$, the first stage latches L1*a*, L1*b* receive the video signals corresponding to the pixels $pxl_{m1y}$, $pxl_{m2y}$, respectively.

At time point t4, the switch-setting signals $S_{sw13}$, $S_{sw24}$ transit from the off-level to the on-level. The switch-setting signals $S_{sw13}$, $S_{sw24}$ transit from the on-level to the off-level at time point t5. Therefore, between time point t4 and time point t5, the channel setting module is at the setting state STa (FIG. 10A). At time point t4, the source line $SL_{m3}$ starts to rise to the pixel voltage $V_{m3y}$, and the source line $SL_{m4}$ starts to rise to the pixel voltage $V_{m4y}$. In the de-multiplexed duration $T_{dmux1}$, the source line $SL_{m3}$ is continuously biased by the output voltage $S_{out1}$, and the potential of the source line $SL_{m3}$ is equivalent to the pixel voltage $V_{m3y}$. In the de-multiplexed duration $T_{dmux1}$, the source line $SL_{m4}$ is continuously biased by the output voltage $S_{out2}$, and the potential of the source line $SL_{m4}$ is equivalent to the pixel voltage $V_{m4y}$. On the other hand, the potentials of the source lines $SL_{m1}$, $SL_{m2}$ are not changed during the de-multiplexed duration $T_{dmux1}$ as the de-mux switches sw11, sw22 are turned off.

Between time point t5 and time point t8 (the gap duration ΔTg), the channel setting module setMDL_m is at a transition state between the setting state STα and the setting state STβ. In the transition state, the de-mux switches sw13, sw24, sw11, sw22, sw33, sw44 are all turned off because the switch-setting signals $S_{sw13}$, $S_{sw24}$, $S_{sw11}$, $S_{sw22}$, $S_{sw33}$, $S_{sw44}$ are at the off-level. During the gap duration ΔTg, the potentials of the source lines $SL_{m1}$, $SL_{m2}$, $SL_{m3}$, $SL_{m4}$ remain unchanged.

At time point t8, the switch-setting signals $S_{sw11}$, $S_{sw22}$, $S_{sw33}$, $S_{sw44}$ transit from the off-level to the on-level. Therefore, between time point t8 and time point t10, the channel setting module is at the setting state STβ (FIG. 10B). At time point t8, the source line $SL_{m1}$ starts to rise to the pixel voltage $V_{m1y}$, and the source line $SL_{m2}$ starts to rise to the pixel voltage $V_{m2y}$. In the de-multiplexed duration $T_{dmux2}$, the source line $SL_{m1}$ is continuously biased by the output voltage $S_{out1}$, and the potential of the source line $SL_{m1}$ is equivalent to the pixel voltage $V_{m1y}$. In the de-multiplexed duration $T_{dmux2}$, the source line $SL_{m2}$ is continuously biased by the output voltage $S_{out2}$, and the potential of the source line $SL_{m2}$ is equivalent to the pixel voltage $V_{m2y}$. On the other hand, during the de-multiplexed duration $T_{dmux2}$, the source line $SL_{m3}$ receives the converted signal $S_{cnv3}$ from the converting circuit p2DAC as the de-mux switch sw33 is turned on, and the source line $SL_{m4}$ receives the converted signal $S_{cnv4}$ from the converting circuit n2DAC as the de-mux switch sw44 is turned on.

The dotted circle C3 shows that the source line $SL_{m3}$ might have overshoot at the beginning of the de-multiplexed duration $T_{dmux2}$, as the biased source line $SL_{m2}$ might cause coupling effects to the source lines $SL_{m3}$. Due to the overshoot, the potential of the source lines $SL_{m3}$ is slightly affected and rises to a value slightly higher than the pixel voltage $V_{m2y}$ at and time point t8. Whereas, the potential of the source line $SL_{m3}$ drops again and transits to the pixel voltage $V_{m3y}$ because the de-mux switch sw33 is turned on, and the source line $SL_{m3}$ starts to receive supplement charges from the converting circuit p2DAC.

In FIG. 11, the potential of the source lines $SL_{m4}$ is shown with two waveforms, depending on the value of m. When m=M, the source line $SL_{m4}$ represents the source line SL[X] of the display panel, and the source line SL[X−1] is the only source line adjacent to the source line SL[X]. As the source lines SL[X−1] (that is, the source line $SL_{m3}$), SL[X] (that is, the source line $SL_{m4}$) receive output voltages $S_{out1}$, $S_{out2}$ synchronously, the potential of the source line SL[X] is not affected by the changes of the source line SL[X−1]. Therefore, the source line $SL_{m4}$ does not have overshoot when m=M.

When m≠M, the source line $S_{Lm4}$ has two adjacent source lines, including the source line $SL_{m3}$ in the same channel setting module setMDL_m and another source line $SL_{m1}$ in the neighboring channel setting module setMDL_(m+1). The source line $SL_{m4}$ is thus affected by the first source line $SL_{m1}$ in the (m+1)-th channel setting module setMDL_m, and an overshoot occurs after time point t8. Please note that when m≠M, the potential changes of the source line $SL_{m4}$ should be similar to those of the source line $SL_{m3}$.

As shown in FIG. 11, when the gate pulse duration T_gl(y) ends at time point t9, the potentials of the source lines $SL_{m1}$, $SL_{m2}$, $SL_{m3}$, $SL_{m4}$ are respectively equivalent to the pixel voltages $V_{m1y}$, $V_{m2y}$, $V_{m3y}$, $V_{m4y}$. Therefore, the luminous intensities of the pixels $pxl_{m1y}$, $pxl_{m2y}$, $pxl_{m3y}$, $pxl_{m4y}$ are not affected by the coupling effects.

In the third embodiment, the de-multiplexed duration $T_{dmux1}$ is mainly used for providing output voltages $S_{out3}$, $S_{out4}$. Moreover, the de-multiplexed duration $T_{dmux2}$ is used for simultaneously providing output voltages $S_{out1}$, $S_{out2}$ to the source lines $SL_{m1}$, $SL_{m2}$, and compensating the side effect of the coupling at the source lines $SL_{m3}$, $SL_{m4}$ at the same time. The length of the de-multiplexed duration $T_{dmux1}$ is equivalent to the length of the de-multiplexed duration $T_{dmux2}$. The state-changing sequence of the channel setting module setMDL_m in the third embodiment is summarized in Table 5.

TABLE 5

| duration | state of the channel setting module setMDL_m | biased source lines | floating source lines |
|---|---|---|---|
| de-multiplexed duration $T_{dmux1}$ | setting state STα (FIG. 10A) | $SL_{m1}$, $SL_{m2}$ | $SL_{m3}$, $SL_{m4}$ |
| gap duration ΔTg | transition state | not available | $SL_{m1}$, $SL_{m2}$, $SL_{m3}$, $SL_{m4}$ |
| de-multiplexed duration $T_{dmux2}$ | setting state STβ (FIG. 10B) | $SL_{m1}$, $SL_{m2}$, $SL_{m3}$, $SL_{m4}$ | not available |

For the application of LCD panels, the polarity inversion function needs to be concerned. Therefore, FIG. 12 shows how the third embodiment is further modified for the LCD application.

Figure 12:
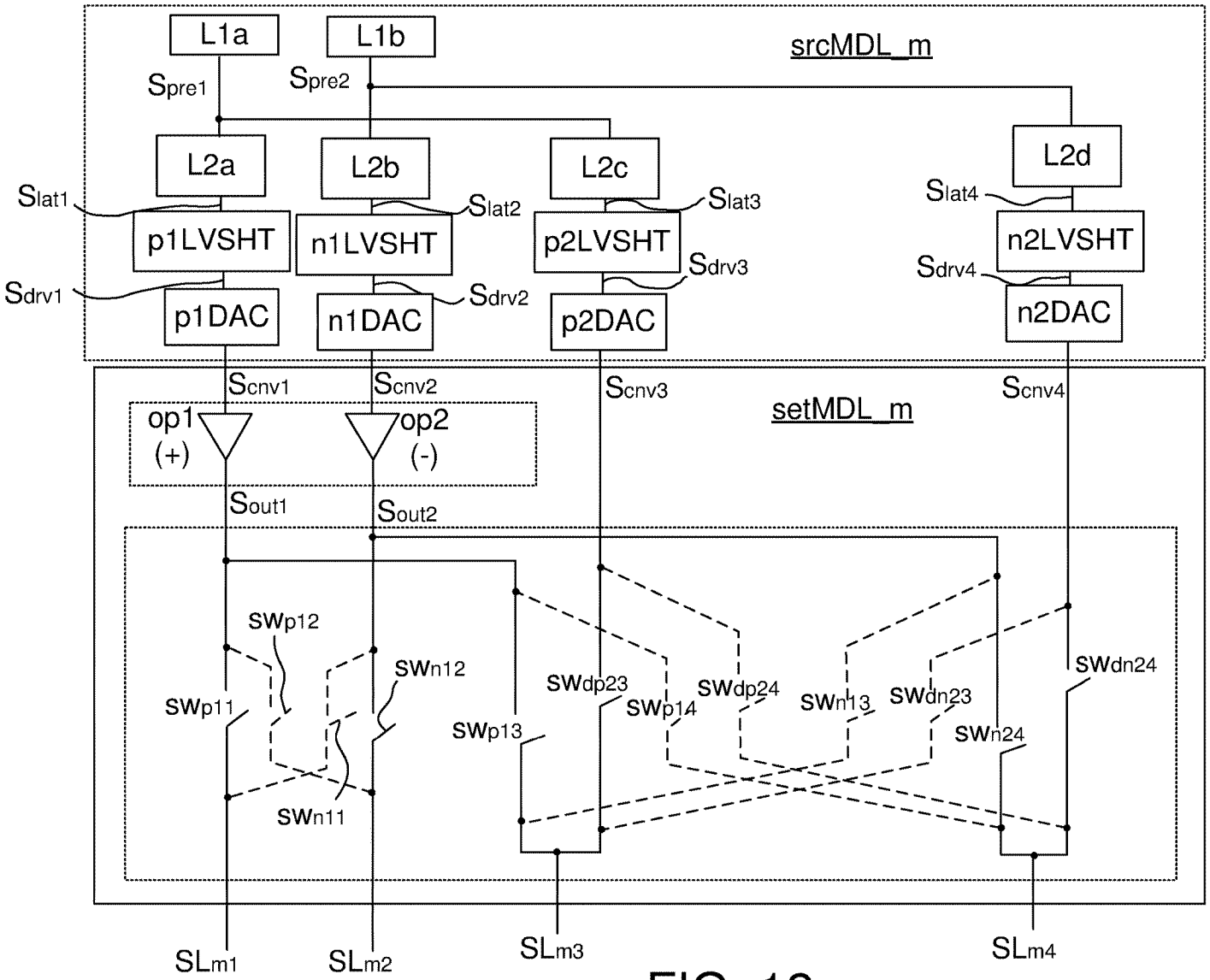
FIG. 12 is a schematic diagram illustrating the design of the channel setting module setMDL_m with polarity switching function according to the third embodiment of the present disclosure.

FIG. 12 is a schematic diagram illustrating the design of the channel setting module setMDL_m with polarity switching function according to the third embodiment of the present disclosure. As the source control module srcMDL_m has similar components and connections in FIG. 9, details are omitted to avoid redundancy.

The channel setting module setMDL_m includes operational amplifiers op1, op2, and de-mux switches $sw_{p11}$, $sw_{n12}$, $sw_{p13}$, $sw_{dp23}$, $sw_{n24}$, $sw_{dn24}$, $sw_{p12}$, $sw_{n11}$, $sw_{p14}$, $sw_{dp24}$, $sw_{n13}$, $sw_{dn23}$. The de-mux switches $sw_{p11}$, $sw_{n12}$, $sw_{p13}$, $sw_{dp23}$, $sw_{n24}$, $Sw_{dn24}$, $sw_{p12}$, $sw_{n11}$, $sw_{p14}$, $sw_{dp24}$, $sw_{n13}$, $sw_{dn23}$ in FIG. 12 can be classified into two groups, respectively shown in solid lines and dotted lines.

The de-mux switches show in solid lines ($sw_{p11}$, $sw_{n12}$, $sw_{p13}$, $sw_{dp23}$, $sw_{n24}$, $sw_{n24}$, $sw_{dn24}$) are selectively turned on when the polarity setting signal PL is at the on-level (PL=1), and all turned off when the polarity setting signal PL is at the off-level (PL=0). The de-mux switches shown in dotted lines ($sw_{p12}$, $sw_{n11}$, $sw_{p14}$, $sw_{dp24}$, $sw_{n13}$, $sw_{dn23}$) are all turned off when the polarity setting signal PL is at the on-level, and selectively turned on when the polarity setting signal PL is at the off-level.

The channel setting module setMDL_m in FIG. 12 might be at the states as shown in FIGS. 13A, 13B, 14A, and 14B, depending on the polarity setting signal PL and the loading pulses LD1, LD2. The states of the channel setting module setMDL_m in FIG. 12 are summarized in Table 6.

TABLE 6

Figure 13A:
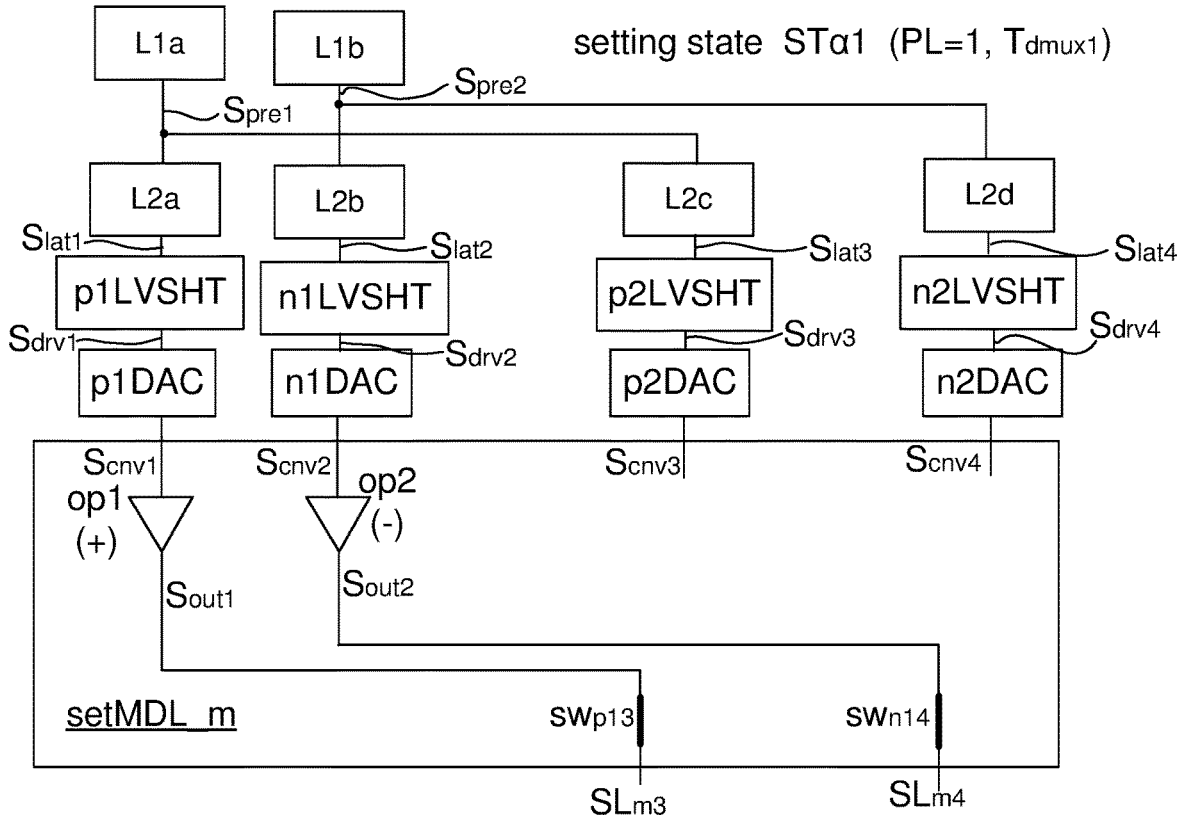
FIGS. 13A and 13B are schematic diagrams illustrating different setting states of the channel setting module setMDL_m in FIG. 12 when the polarity inversion signal PL is at the on-level (PL=1).
Figure 13B:
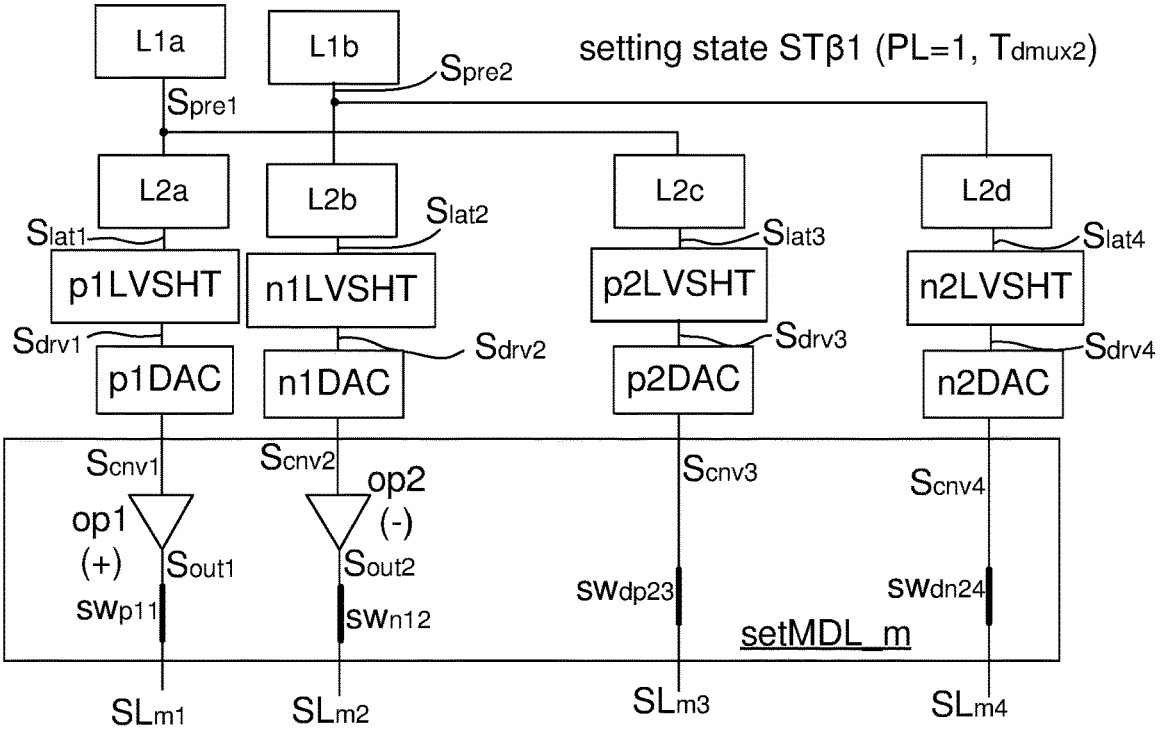
Figure 14A:
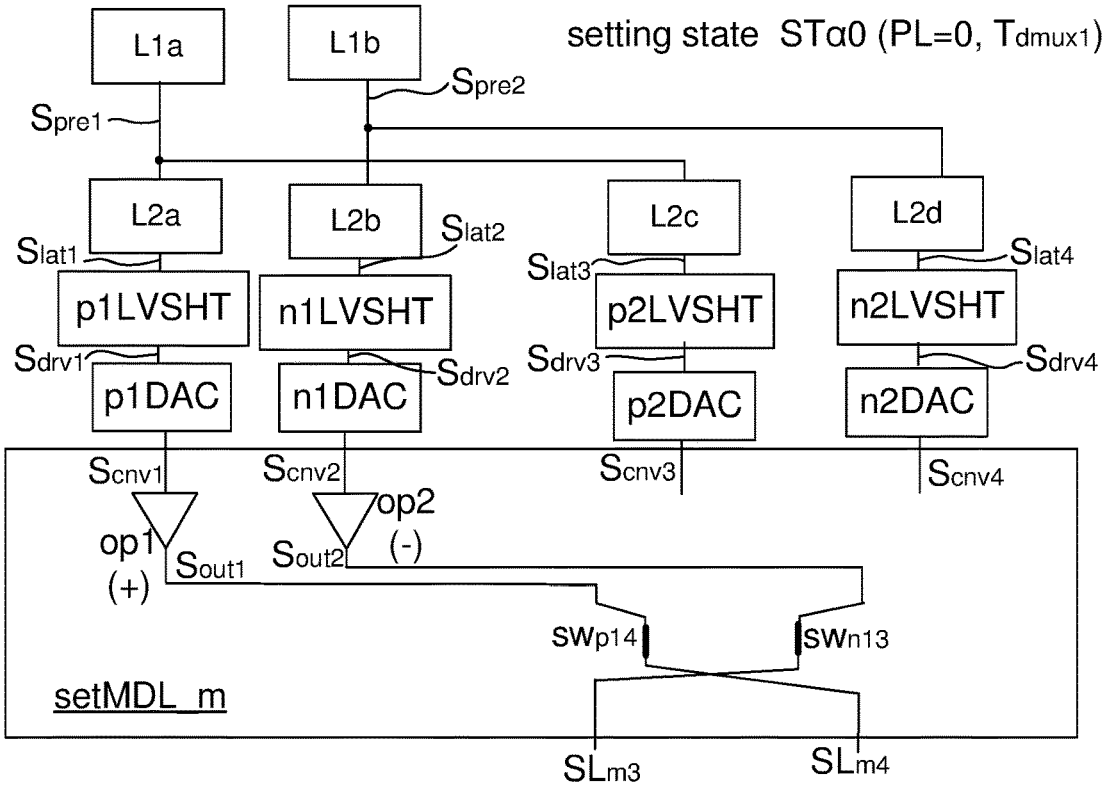
FIGS. 14A and 14B are schematic diagrams illustrating different setting states of the channel setting module setMDL_m in FIG. 12 when the polarity inversion signal PL is at the off-level (PL=0).
Figure 14B:
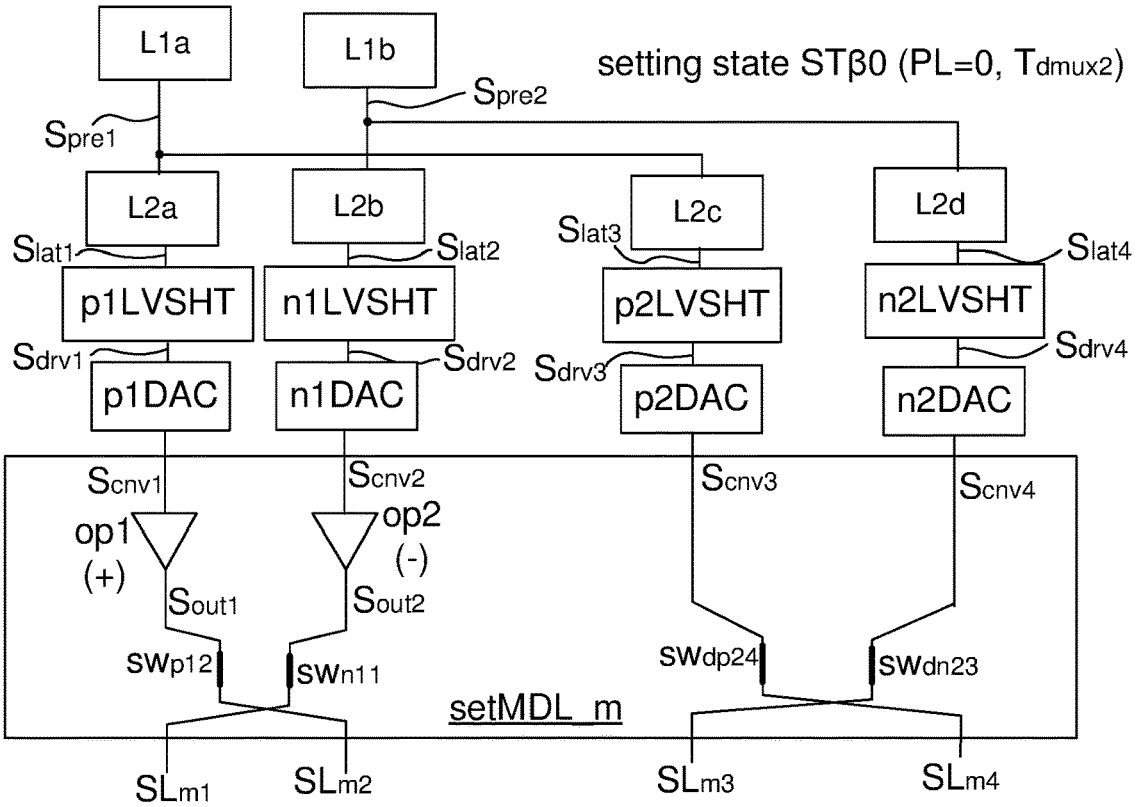

| de-mux switches | | states | FIG. | de-mux switches being turned on | de-mux switches being turned off |
|---|---|---|---|---|---|
| shown in solid lines (selectively turned on when PL = 1) | $sw_{p11}$, $sw_{n12}$, $sw_{p13}$, $sw_{dp23}$, $sw_{n24}$, $sw_{dn24}$ | setting state corresponding to $T_{dmux1}$ | FIG. 13A | $sw_{p13}$, $sw_{n24}$ | $sw_{p11}$, $sw_{n12}$, $sw_{dp23}$, $sw_{dn24}$ |
| | | transition state | not available | not available | $sw_{p11}$, $sw_{n12}$, $sw_{p13}$, $sw_{dp23}$, $sw_{n24}$, $sw_{dn24}$ |
| | | setting state corresponding to $T_{dmux2}$ | FIG. 13B | $sw_{p11}$, $sw_{n12}$, $sw_{dp23}$, $sw_{dn24}$ | $sw_{p13}$, $sw_{n24}$ |
| shown in dotted lines (selectively turned on when PL = 0) | $sw_{p12}$, $sw_{n11}$, $sw_{p14}$, $sw_{dp24}$, $sw_{n13}$, $sw_{dn23}$ | setting state corresponding to $T_{dmux1}$ | FIG. 14A | $sw_{n13}$, $sw_{p14}$ | $sw_{p12}$, $sw_{n11}$, $sw_{dp24}$, $sw_{dn23}$ |
| | | transition state | not available | not available | $sw_{p12}$, $sw_{n11}$, $sw_{p14}$, $sw_{dp24}$, $sw_{n13}$, $sw_{dn23}$ |
| | | setting state corresponding to $T_{dmux2}$ | FIG. 14B | $sw_{p12}$, $sw_{n11}$, $sw_{dp24}$, $sw_{dn23}$ | $sw_{n13}$, $sw_{p14}$ |

The control of the channel setting module setMDL_m in FIG. 12 is varied with the on-level or the off-level of the polarity setting signal PL, and it can be analog to the structure of FIG. 9. For example, the de-multiplexed duration $T_{dmux1}$ represented by FIGS. 13A and 14A can be analog to the FIG. 10A, and the de-multiplexed duration $T_{dmux2}$ represented by FIGS. 13B and 14B can be analog to FIG. 10B.

FIGS. 13A and 13B are schematic diagrams illustrating different setting states of the channel setting module setMDL_m in FIG. 12 when the polarity setting signal PL is at the on-level (PL=1). In FIGS. 13A and 13B, the de-mux switches ($sw_{p13}$, $sw_{n14}$, $sw_{p11}$, $sw_{n12}$, $sw_{dp23}$, $sw_{dn24}$), like those shown in solid lines in FIG. 12, are alternately turned on.

FIG. 13A represents the setting state (STα1) of the channel setting module setMDL_m in the de-multiplexed duration $T_{dmux1}$. In FIG. 13A, the de-mux switches $sw_{p13}$, $sw_{n14}$ are turned on, and the de-mux switches $sw_{p11}$, $sw_{n12}$, $sw_{dp23}$, $sw_{dn24}$ (not shown) are turned off. Therefore, the output voltage $S_{out1}$ is supplied to the source line $SL_{m3}$ through the conducted de-mux switch $sw_{p13}$, and the output voltage $S_{out2}$ is supplied to the source line $SL_{m4}$ through the conducted de-mux switch $sw_{n14}$.

FIG. 13B represents the setting state (STβ1) of the channel setting module setMDL_m in the de-multiplexed duration $T_{dmux2}$. In FIG. 13B, the de-mux switches $sw_{p13}$, $sw_{n14}$ (not shown) are turned off, and the de-mux switches $sw_{p11}$, $sw_{n12}$, $sw_{dp23}$, $sw_{dn24}$ are turned on. Therefore, the output voltage ($S_{out1}$) is supplied to the source line $SL_{m1}$ through the conducted de-mux switch $sw_{p11}$, the output voltage ($S_{out2}$) is supplied to the source line $SL_{m2}$ through the conducted de-mux switch $sw_{n12}$, supplement charges are provided from the converted signal $S_{cnv3}$ to the source line $SL_{m3}$ through the conducted de-mux switch $sw_{dp23}$, and supplement charges are provided from the converted signal $S_{cnv4}$ to the source line $SL_{m4}$ through the conducted de-mux switch $sw_{dn24}$.

FIGS. 14A and 14B are schematic diagrams illustrating different setting states of the channel setting module setMDL_m in FIG. 12 when the polarity setting signal PL is at the off-level (PL=0). In FIGS. 14A and 14B, the de-mux switches ($sw_{p14}$, $sw_{n13}$, $sw_{p12}$, $sw_{n11}$, $sw_{dp24}$, $sw_{dn23}$) shown in dotted lines in FIG. 12 are alternately turned on.

FIG. 14A represents the setting state (STα0) of the channel setting module setMDL_m in the de-multiplexed duration $T_{dmux1}$. In FIG. 14A, the de-mux switches $sw_{p14}$, $sw_{n13}$ are turned on, and the de-mux switches $sw_{p12}$, $Sw_{n11}$, $sw_{dp24}$, $sw_{dn23}$ (not shown) are turned off. Therefore, the output voltage $S_{out1}$ is supplied to the source line $SL_{m3}$ through the conducted de-mux switch $sw_{n13}$, and the output voltage $S_{out2}$ is supplied to the source line $SL_{m4}$ through the conducted de-mux switch $sw_{p14}$.

FIG. 14B represents the setting state (STβ0) of the channel setting module setMDL_m in the de-multiplexed duration $T_{dmux2}$. In FIG. 14B, the de-mux switches $sw_{p14}$, $sw_{n13}$ (not shown) are turned off, and the de-mux switches $sw_{p12}$, $sw_{n11}$, $sw_{dp24}$, $sw_{dn23}$ are turned on. Therefore, the output voltage ($S_{out2}$) is supplied to the source line $SL_{m1}$ through the conducted de-mux switch $sw_{n11}$, the output voltage ($S_{out1}$) is supplied to the source line $SL_{m2}$ through the conducted de-mux switch $sw_{n11}$, supplement charges are provided from the converted signal $S_{cnv4}$ to the source line $SL_{m3}$ through the conducted de-mux switch $sw_{dn23}$, and supplement charges are provided from the converted signal $S_{cnv3}$ to the source line $SL_{m4}$ through the conducted de-mux switch $sw_{dp24}$.

Figure 15A:
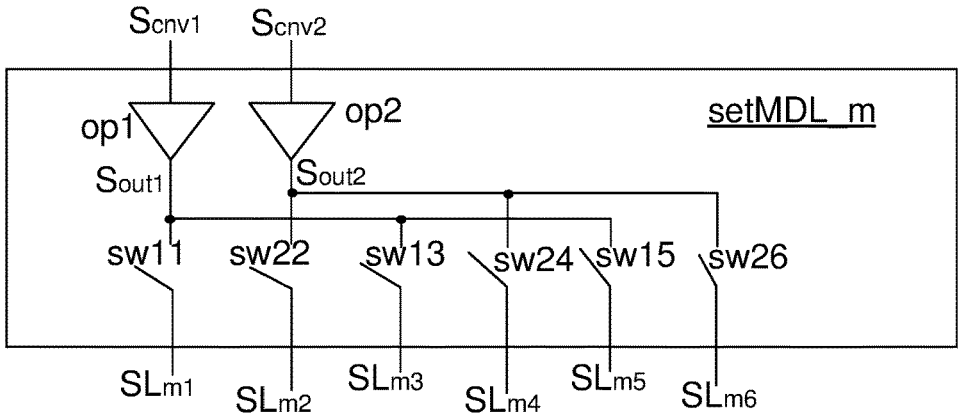
FIGS. 15A-15C are schematic diagrams illustrating different implementations of the channel setting module setMDL_m.
Figure 15B:
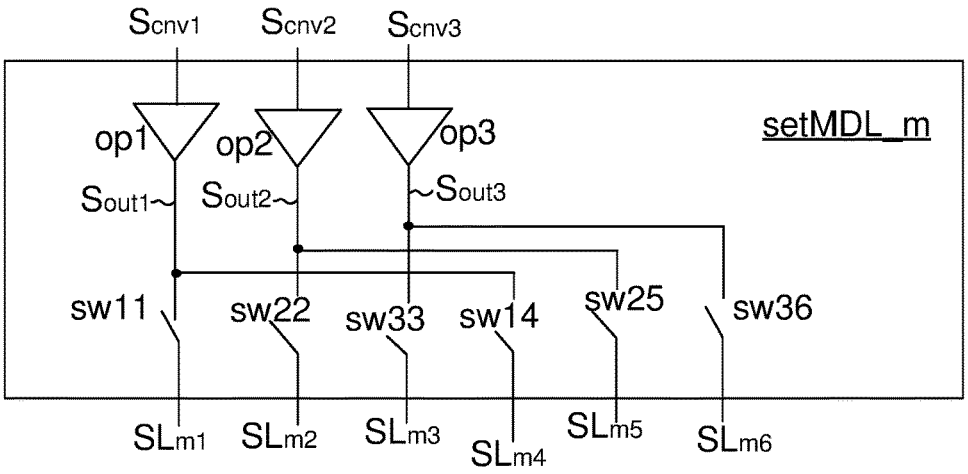
Figure 15C:
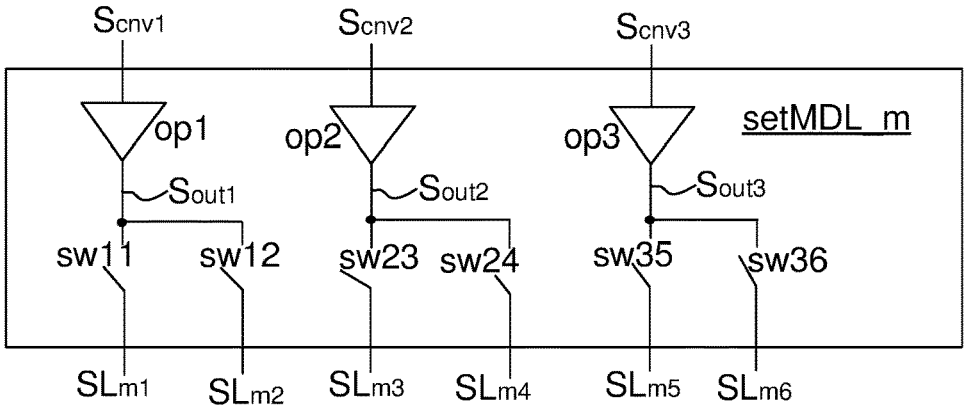

In practical applications, the number of operational amplifiers and the number of de-mux switches in the channel setting module setMDL_m should not be limited. FIGS. 15A-15C are schematic diagrams illustrating different implementations of the channel setting module setMDL_m. The internal components and connection relationships of the channel setting module setMDL_m in FIGS. 15A-15C are not described but only listed in Table 7.

TABLE 7

| channel setting module setMDL_m | FIG. 15A | FIG. 15B | FIG. 15C |
|---|---|---|---|
| number of corresponding source lines (J) | | 6 | |
| number of operational amplifiers (K) | 2 | | 3 |
| number of de-mux switches | 3 | | 2 |

TABLE 7-continued

| channel setting module setMDL_m | | FIG. 15A | FIG. 15B | FIG. 15C |
|---|---|---|---|---|
| corresponding to each operational amplifiers (N) | | | | |
| de-mux switches being electrically connected to operational amplifiers | op1 | sw11, sw13, sw15 | sw11, sw14 | sw11, sw12 |
| | op2 | sw22, sw24, sw26 | sw22, sw25 | sw23, sw24 |
| | op3 | not available | sw33, sw36 | sw35, sw36 |
| source lines being selectively electrically connected to operational amplifiers | op1 | $SL_{m1}$, $SL_{m3}$, $SL_{m5}$ | $SL_{m1}$, $SL_{m4}$ | $SL_{m1}$, $SL_{m2}$ |
| | op2 | $SL_{m2}$, $SL_{m4}$, $SL_{m6}$ | $SL_{m2}$, $SL_{m5}$ | $SL_{m3}$, $SL_{m4}$ |
| | op3 | not available | $SL_{m3}$, $SL_{m6}$ | $SL_{m5}$, $SL_{m6}$ |
| suitable types of display panel | | OLED, LCD | | OLED |

Please refer to FIGS. 15A-15C and Table 7 together. In FIGS. 15A and 15B, the operational amplifiers in the channel setting module setMDL_m are not conducted to any two adjacent source lines. Thus, FIGS. 15A and 15B can be applied to OLED display panels and LCD panels. As the LCD panels need to support the polarity switching function, FIG. 15C is not applicable to LCD panels. The above-mentioned embodiments can be applied to the channel setting module setMDL_m in FIGS. 15A-15C, through suitable modifications. Details about such applications are not described to avoid redundancy.

By utilizing the control methods described in the embodiments, the channel setting module setMDL_m is capable of depressing the side effects of coupling. In consequence, potentials of the floating source lines can be maintained as the desired pixel voltages by the time the potential of the gate line GL[y] is dropped to the off-level.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A control method of a channel setting module applied to a display panel, wherein the channel setting module comprises a first operational amplifier and a second operational amplifier, and the control method comprises steps of:

in a first de-multiplexed duration, supplying an output voltage of the first operational amplifier to a first source line of the display panel, and supplying an output voltage of the second operational amplifier to a second source line of the display panel;

in a second de-multiplexed duration, supplying the output voltage of the first operational amplifier to a third source line of the display panel, and supplying the output voltage of the second operational amplifier to the second source line of the display panel; and in a third de-multiplexed duration, supplying the output voltage of the first operational amplifier to the third source line of the display panel, and supplying the output voltage of the second operational amplifier to a fourth source line of the display panel, wherein the first de-multiplexed duration is before the second de-multiplexed duration, and the second de-multiplexed duration is before the third de-multiplexed duration.

2. The control method according to claim 1, wherein the channel setting module further comprises a first de-mux switch being electrically connected to the first operational amplifier and the first source line, a second de-mux switch being electrically connected to the second operational amplifier and the second source line, a third de-mux switch being electrically connected to the first operational amplifier and the third source line, and a fourth de-mux switch being electrically connected to the second operational amplifier and the fourth source line, wherein in the first de-multiplexed duration, the first and the second de-mux switches are turned on, and the third and the fourth de-mux switches are turned off;

in the second de-multiplexed duration, the first and the fourth de-mux switches are turned off, and the second and the third de-mux switches are turned on; and in a third de-multiplexed duration, the first and the second de-mux switches are turned off, and the third and the fourth de-mux switches are turned on.

3. The control method according to claim 2, wherein in a first gap duration between the first and the second de-multiplexed durations, the first, the third, and the fourth de-mux switches are turned off, and the second de-mux switch is turned on; and in a second gap duration between the second and the third de-multiplexed durations, the first, the second, and the fourth de-mux switches are turned off, and the third de-mux switch is turned on.

4. The control method according to claim 1, further comprising steps of:

amplifying a first converted signal, by the first operational amplifier, to generate the output voltage of the first operational amplifier; and amplifying a second converted signal, by the second operational amplifier, to generate the output voltage of the second operational amplifier, wherein in the first de-multiplexed duration, the output voltage of the first operational amplifier is equivalent to a first pixel voltage representing luminous intensity of a first pixel, and the output voltage of the second operational amplifier is equivalent to a second pixel voltage representing luminous intensity of a second pixel;

in the second de-multiplexed duration, the output voltage of the first operational amplifier is equivalent to a third pixel voltage representing luminous intensity of a third pixel, and the output voltage of the second operational amplifier is equivalent to the second pixel voltage; and in the third de-multiplexed duration, the output voltage of the first operational amplifier is equivalent to the third pixel voltage, and the output voltage of the second operational amplifier is equivalent to a fourth pixel voltage representing luminous intensity of a fourth pixel, wherein the first, the second, the third, and the fourth pixels are respectively electrically connected to the first, the second, the third, and the fourth source lines, and the first, the second, the third, and the fourth pixels are jointly electrically connected to a gate line of the display panel.

5. The control method according to claim 1, wherein the first de-multiplexed duration, the second de-multiplexed duration, and the third de-multiplexed duration are within a horizontal line duration, wherein length of the first de-multiplexed duration is longer than length of the second de-multiplexed duration, and length of the third de-multiplexed duration is longer than the length of the second de-multiplexed duration.

6. The control method according to claim 5, wherein the length of the first de-multiplexed duration is equivalent to the length of the third de-multiplexed duration.

7. A control method of a channel setting module applied to a display panel, wherein the channel setting module comprises a first and a second operational amplifiers, and the control method comprises steps of:

in a first de-multiplexed duration, supplying an output voltage of the first operational amplifier to a first source line of the display panel, and supplying an output voltage of the second operational amplifier to a second source line of the display panel;

in a second de-multiplexed duration, supplying the output voltage of the first operational amplifier to a third source line of the display panel, and supplying the output voltage of the second operational amplifier to a fourth source line of the display panel; and in a third de-multiplexed duration, supplying the output voltage of the first operational amplifier to the first source line, and supplying the output voltage of the second operational amplifier to the second source line, wherein the first de-multiplexed duration is before the second de-multiplexed duration, and the second de-multiplexed duration is before the third de-multiplexed duration.

8. The control method according to claim 7, wherein the channel setting module further comprises:

a first de-mux switch being electrically connected to the first operational amplifier and the first source line;

a second de-mux switch being electrically connected to the second operational amplifier and the second source line;

a third de-mux switch being electrically connected to the first operational amplifier and the third source line; and a fourth de-mux switch being electrically connected to the second operational amplifier and the fourth source line, wherein in the first and the third de-multiplexed durations, the first and the second de-mux switches are turned on, and the third and the fourth de-mux switches are turned off, and in the second de-multiplexed duration, the first and the second de-mux switches are turned off, and the third and the fourth de-mux switches are turned on.

9. The control method according to claim 8, wherein a first gap duration is between the first and the second de-multiplexed durations, and a second gap duration is between the second and the third de-multiplexed durations, wherein the first, the second, the third, and the fourth de-mux switches are turned off in the first and the second gap durations.

10. The control method according to claim 7, further comprising steps of:

amplifying a first converted signal, by the first operational amplifier, to generate the output voltage of the first operational amplifier; and amplifying a second converted signal, by the second operational amplifier, to generate the output voltage of the second operational amplifier, wherein in the first and the third de-multiplexed durations, the output voltage of the first operational amplifier is equivalent to a first pixel voltage representing luminous intensity of a first pixel, and the output voltage of the second operational amplifier is equivalent to a second pixel voltage representing luminous intensity of a second pixel, and in the second de-multiplexed duration, the output voltage of the first operational amplifier is equivalent to a third pixel voltage representing luminous intensity of a third pixel, and the output voltage of the second operational amplifier is equivalent to a fourth pixel voltage representing luminous intensity of a fourth pixel, wherein the first, the second, the third, and the fourth pixels are respectively electrically connected to the first, the second, the third, and the fourth source lines, and the first, the second, the third, and the fourth pixels are jointly electrically connected to a gate line of the display panel.

11. The control method according to claim 7, wherein the first, the second, and the third de-multiplexed durations are within a horizontal line duration, wherein length of the first de-multiplexed duration is longer than length of the third de-multiplexed duration, and length of the second de-multiplexed duration is longer than the length of the third de-multiplexed duration.

12. The control method according to claim 7, wherein the length of the first de-multiplexed duration is equivalent to the length of the second de-multiplexed duration.

13. A control method of a channel setting module applied to a display panel, wherein the display panel comprises a first, a second, a third, and a fourth source lines, and the channel setting module comprises a first and a second operational amplifiers, wherein the control method comprises steps of:

receiving a first, a second, a third, and a fourth converted signals, from a first, a second, a third, and a fourth converting circuits, respectively;

amplifying the first converted signal, by the first operational amplifier, to generate an output voltage of the first operational amplifier;

amplifying the second converted signal, by the second operational amplifier, to generate an output voltage of the second operational amplifier;

in a first de-multiplexed duration, supplying the output voltage of the first operational amplifier to one of the third source line and the fourth source line, and supplying the output voltage of the second operational amplifier to the other of the third source line and the fourth source line; and in a second de-multiplexed duration, supplying the output voltage of the first operational amplifier to one of the first source line and the second source line, supplying the output voltage of the second operational amplifier to the other of the first source line and the second source line, conducting the third converted signal to the one of the third source line and the fourth source line, and conducting the fourth converted signal to the other of the third source line and the fourth source line, wherein the first de-multiplexed duration is before the second de-multiplexed duration.

14. The control method according to claim 13, wherein the channel setting module further comprises:

a first de-mux switch, electrically connected to the first operational amplifier and the one of the first source line and the second source line, wherein the first operational amplifier is electrically connected to the first converting circuit;

a second de-mux switch, electrically connected to the second operational amplifier and the other of the first source line and the second source line, wherein the second operational amplifier is electrically connected to the second converting circuit;

a third de-mux switch, electrically connected to the first operational amplifier;

a fourth de-mux switch, electrically connected to the third converting circuit, wherein the third and the fourth de-mux switches are jointly electrically connected to the one of the third source line and the fourth source line;

a fifth de-mux switch, electrically connected to the second operational amplifier; and a sixth de-mux switch, electrically connected to the fourth converting circuit, wherein the fifth and the sixth de-mux switches are jointly electrically connected to the other of the third source line and the fourth source line.

15. The control method according to claim 14, wherein in the first de-multiplexed duration, the first, the second, the fourth, and the sixth de-mux switches are turned off, and the third and the fifth de-mux switches are turned on; and in the second de-multiplexed duration, the first, the second, the fourth and the sixth de-mux switches are turned on, and the third and the fifth de-mux switches are turned off.

16. The control method according to claim 14, wherein the first, the second, the third, the fourth, the fifth, and the sixth de-mux switches are turned off in a gap duration between the first and the second de-multiplexed durations.

17. The control method according to claim 13, wherein a first loading pulse is received before beginning of the first de-multiplexed duration; and a second loading pulse is received after end of the first de-multiplexed duration and before beginning of the second de-multiplexed duration.

18. The control method according to claim 17, wherein in the second de-multiplexed duration, the output voltage of the first operational amplifier is equivalent to a first pixel voltage representing luminous intensity of a first pixel, the output voltage of the second operational amplifier is equivalent to a second pixel voltage representing luminous intensity of a second pixel, the third converted signal supplies charges to a third pixel, and the fourth converted signal supplies charges to a fourth pixel; and in the first de-multiplexed duration, the output voltage of the first operational amplifier is equivalent to a third pixel voltage representing luminous intensity of the third pixel, and the output voltage of the second operational amplifier is equivalent to a fourth pixel voltage representing luminous intensity of the fourth pixel.

19. The control method according to claim 18, wherein the first, the second, the third, and the fourth pixels are respectively electrically connected to the first, the second, the third, and the fourth source lines, and the first, the second, the third, and the fourth pixels are jointly electrically connected to a gate line of the display panel.

20. The control method according to claim 13, wherein the first de-multiplexed duration and the second de-multiplexed duration are within a horizontal line duration, wherein length of the first de-multiplexed duration is equivalent to length of the second de-multiplexed duration.

* * * * *